US009710993B2

(12) United States Patent
Makino et al.

(10) Patent No.: US 9,710,993 B2
(45) Date of Patent: Jul. 18, 2017

(54) PRODUCT DISCHARGING DEVICE

(71) Applicant: FUJI ELECTRIC CO., LTD., Kawasaki-shi, Kanagawa (JP)

(72) Inventors: Michihiko Makino, Yokkaichi (JP); Yoshio Yasaka, Yokkaichi (JP); Norio Nakajima, Yokkaichi (JP); Tsutomu Iwako, Yokkaichi (JP)

(73) Assignee: FUJI ELECTRIC CO., LTD., Kawasaki-Shi, Kanagawa (JP)

( * ) Notice: Subject to any disclaimer, the term of this patent is extended or adjusted under 35 U.S.C. 154(b) by 0 days.

(21) Appl. No.: 15/055,104

(22) Filed: Feb. 26, 2016

(65) Prior Publication Data

US 2016/0180630 A1 Jun. 23, 2016

Related U.S. Application Data

(63) Continuation of application No. PCT/JP2015/050396, filed on Jan. 8, 2015.

(30) Foreign Application Priority Data

Jan. 10, 2014 (JP) ..... 2014-003753
Jul. 18, 2014 (JP) ..... 2014-148244
(Continued)

(51) Int. Cl.
*G07F 11/00* (2006.01)
*B65H 1/00* (2006.01)
(Continued)

(52) U.S. Cl.
CPC ..... *G07F 11/24* (2013.01); *G07F 11/06* (2013.01); *G07F 11/48* (2013.01); *G07F 11/50* (2013.01)

(58) Field of Classification Search
CPC ..... G07F 11/06; G07F 11/50; G07F 11/48; G07F 11/24
(Continued)

(56) References Cited

U.S. PATENT DOCUMENTS 4,142,863 A * 3/1979 Covington ..... B01L 9/52 221/198
4,542,834 A * 9/1985 Kurosawa ..... G07F 11/16 221/116
(Continued)

FOREIGN PATENT DOCUMENTS

JP 2749917 B2 * 5/1998
JP 11283096 A1 * 8/1999
(Continued)

OTHER PUBLICATIONS

PCT, "International Search Report for International Application No. PCT/JP2015/050396".

*Primary Examiner* — Rakesh Kumar
(74) *Attorney, Agent, or Firm* — Manabu Kanesaka

(57) ABSTRACT

A product discharging device includes: a lower pedal that is swingably disposed to move forward to and backward from a product storage passage storing input products in a vertical direction; an upper pedal that is swingably disposed to move forward to and backward from the product storage passage in an area above the lower pedal; a pedal stopper pin that is coupled to a pedal link linking the lower pedal and the upper pedal and that is movable with movement in the vertical direction of the pedal link; and a rotation stopper of which a tip is linked to the lower pedal and that is swingably disposed to move forward to and backward from the product storage passage along with the lower pedal.

4 Claims, 23 Drawing Sheets

(30) Foreign Application Priority Data

Jul. 18, 2014 (JP) ..... 2014-148245
Aug. 6, 2014 (JP) ..... 2014-160314

(51) Int. Cl.
*G07F 11/24* (2006.01)
*G07F 11/06* (2006.01)
*G07F 11/50* (2006.01)
*G07F 11/48* (2006.01)

(58) Field of Classification Search
USPC ..... 221/288, 116, 115, 298, 281, 301, 1, 92, 221/277, 133
See application file for complete search history.

(56) References Cited

U.S. PATENT DOCUMENTS 4,565,300 A * 1/1986 Kokubun ..... G07F 11/10 221/116
4,574,980 A * 3/1986 Kurosawa ..... G07F 11/24 221/116
4,673,105 A * 6/1987 Kurosawa ..... G07F 11/16 221/281
4,776,487 A * 10/1988 Kurosawa ..... G07F 11/24 221/116
4,854,477 A * 8/1989 Kurosawa ..... G07F 11/24 221/1
5,445,296 A * 8/1995 Insausti ..... B65G 59/062 221/298
5,791,516 A * 8/1998 Wittern, Jr. ..... G07F 11/42 221/114
5,799,824 A * 9/1998 Gasiel ..... G07F 11/16 221/112
6,902,084 B2 * 6/2005 Bauman ..... A47F 1/10 221/115
7,431,176 B2 * 10/2008 Bauman ..... A47F 1/10 221/115
7,882,980 B1 * 2/2011 Horn ..... G07F 11/14 221/2
2014/0175116 A1 * 6/2014 Chen ..... G07F 11/48 221/277
2016/0155286 A1 * 6/2016 Yasaka ..... G07F 11/24 221/14
2016/0180630 A1 * 6/2016 Makino ..... G07F 11/24 221/133

FOREIGN PATENT DOCUMENTS

JP 11283096 A * 10/1999
JP 2001-188953 A 7/2001
JP 2001188953 A * 7/2001
JP 2002288732 A1 * 3/2002
JP 2002288732 A * 10/2002
JP 2004288070 A1 * 8/2004
JP 2012-168829 A 9/2012
JP 2013-190927 A 9/2013
JP 2013-196049 A 9/2013
JP 2013019927 A * 9/2013
JP 2013190927 A * 9/2013
JP WO 2015105150 A1 * 7/2015 ..... G07F 11/24

* cited by examiner

PRODUCT DISCHARGING DEVICE

CROSS-REFERENCE TO RELATED APPLICATION(S)

This application is a continuation of PCT international application Ser. No. PCT/JP2015/050396 filed on Jan. 8, 2015 which designates the United States, incorporated herein by reference, and which claims the benefit of priority from Japanese Patent Application No. 2014-003753, filed on Jan. 10, 2014, Japanese Patent Application No. 2014-148244, filed on Jul. 18, 2014, Japanese Patent Application No. 2014-148245, filed on Jul. 18, 2014, and Japanese Patent Application No. 2014-160314, filed on Aug. 6, 2014, the entire contents of all of which are incorporated herein by reference.

BACKGROUND

1. Field of the Disclosure

The present disclosure relates to a product discharging device.

2. Related Art

In the related art, in a vending machine vending product such as canned beverage or beverage in a plastic bottle, a product storage rack is disposed in a product storage in a main cabinet which is a main body of the vending machine. The product storage rack includes a product storage passage that extends in a vertical direction and a product discharging device that is disposed in a lower part of the product storage passage.

The product discharging device includes a lower pedal, an upper pedal, a pedal stopper pin, and a rotation stopper. The lower pedal is swingably disposed to move forward to and backward from the product storage passage. The upper pedal is swingably disposed to move forward to and backward from the product storage passage in an area above the lower pedal. The pedal stopper pin is coupled to a pedal link linking the lower pedal and the upper pedal and is movable with movement in the vertical direction of the pedal link. Here, the pedal link is disposed to be movable in the vertical direction and is linked to an AC solenoid as an actuator. The pedal link moves upward by supplying power to the AC solenoid. The rotation stopper is swingably disposed to move forward to and backward from the product storage passage along with the lower pedal by linking the tip thereof to the lower pedal.

In such a product discharging device, in a standby state, the pedal link moves downward and the upper pedal moves backward from the product storage passage by stopping the supply of power to the AC solenoid, and the lower pedal is held in a state in which the lower pedal moves forward to the product storage passage and downward movement of product is regulated by regulating backward movement of the rotation stopper due to the pedal stopper pin.

When a product discharge command is issued, the pedal link moves upward by supplying power to the AC solenoid, the upper pedal moves forward to the product storage passage and comes in contact with a second lowest product, and the lower pedal moves backward from the product storage passage and discharges the lowest product downward by releasing backward movement of the rotation stopper due to the pedal stopper pin.

The product discharging device includes a blindfold plate in addition to the above-mentioned configuration. The blindfold plate is a flat panel-like member formed of a metal material and covers the side of the pedal stopper pin opposite to the product storage passage to improve antitheft capability (for example, see Japanese Laid-open Patent Publication No. 2013-190927).

In the product discharging device proposed in Japanese Laid-open Patent Publication No. 2013-190927, the blindfold plates corresponding to the number of product discharging devices, that is, the number of product storage passages, are necessary. Since a vending machine is generally provided with plural product storage passages, the necessity for the blindfold plates corresponding to the number of product storage passages causes an increase in manufacturing cost with an increase in the number of components.

There is a need for a product discharging device that can achieve a decrease in manufacturing cost and improvement in antitheft capability.

SUMMARY

Our product discharging device includes: a lower pedal that is swingably disposed to move forward to and backward from a product storage passage storing input products in a vertical direction; an upper pedal that is swingably disposed to move forward to and backward from the product storage passage in an area above the lower pedal; a pedal stopper pin that is coupled to a pedal link linking the lower pedal and the upper pedal and that is movable with movement in the vertical direction of the pedal link; and a rotation stopper of which a tip is linked to the lower pedal and that is swingably disposed to move forward to and backward from the product storage passage along with the lower pedal, wherein in a standby state, the upper pedal moves backward from the product storage passage by causing the pedal link to move downward, the lower pedal is held in a state in which the lower pedal moves forward to the product storage passage to regulate downward movement of the product by regulating backward movement of the rotation stopper due to the pedal stopper pin, in an activated state, the upper pedal moves forward to the product storage passage to come in contact with a second lowest product by causing the pedal link to move upward and the lower pedal moves backward from the product storage passage to discharge a lowest product downward by releasing the regulation of the backward movement of the rotation stopper due to the pedal stopper pin, and the rotation stopper includes a blindfold portion that covers a side of the pedal stopper pin opposite to the product storage passage.

The above and other objects, features, advantages and technical and industrial significance of this disclosure will be better understood by reading the following detailed description of presently preferred embodiments of the disclosure, when considered in connection with the accompanying drawings.

DETAILED DESCRIPTION

Hereinafter, a product discharging device according to an exemplary embodiment of the present disclosure will be described in detail with reference to the accompanying drawings.

Figure 1:
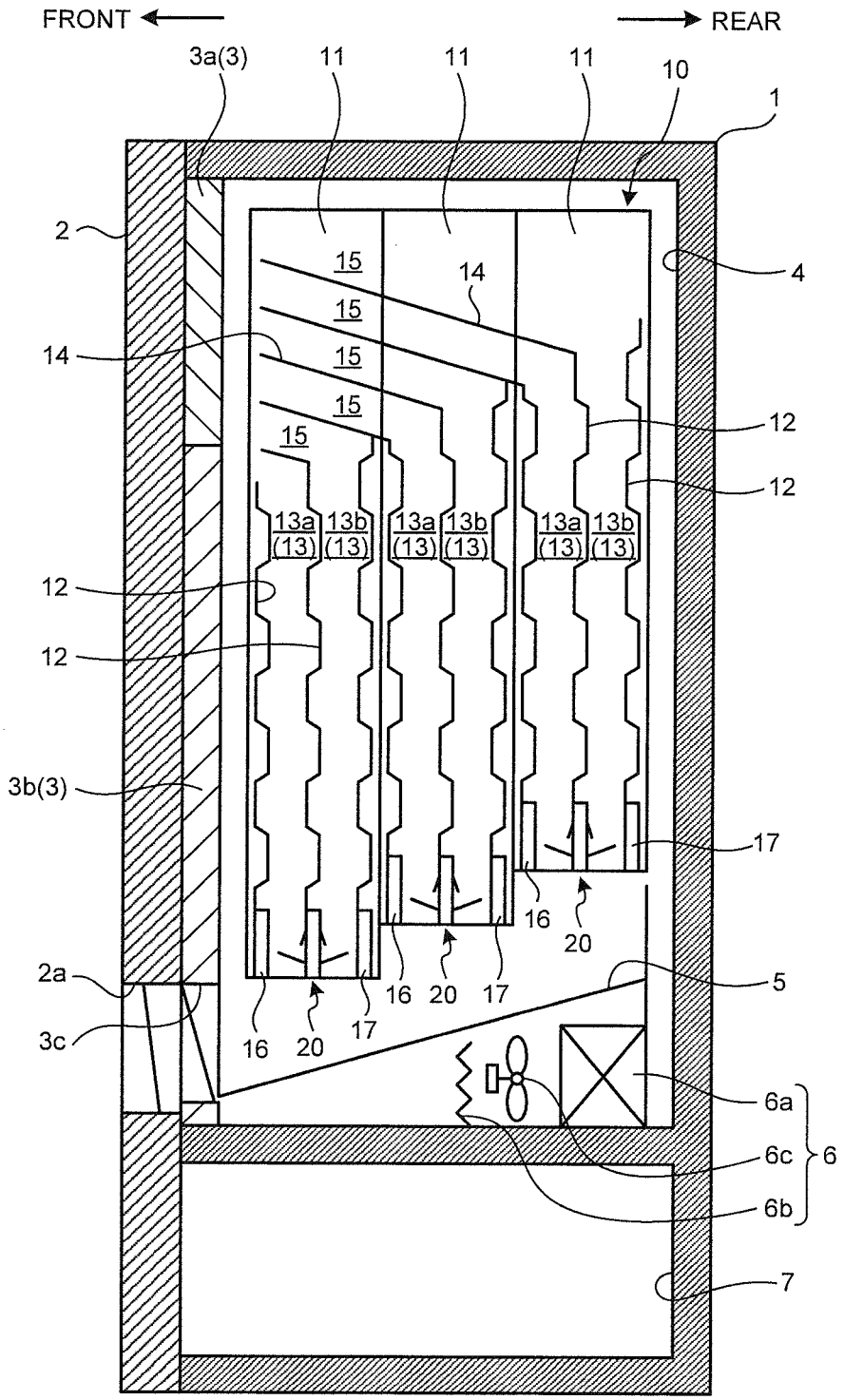
FIG. 1 is a cross-sectional side view illustrating an internal structure of a vending machine to which a product discharging device according to an embodiment of the present disclosure is applied when viewed from the right side.

FIG. 1 is a cross-sectional side view illustrating an internal structure of a vending machine to which the product discharging device according to an embodiment of the present disclosure is applied when viewed from the right side. The vending machine exemplified herein vends product in a cooled or heated state and includes a main cabinet 1, an outer door 2, and an inner door 3.

The main cabinet 1 has a rectangular parallelepiped shape of which a front surface is opened by appropriately combining plural steel sheets and includes a product storage 4 having a heat-insulating structure therein. The outer door 2 serves to cover the front opening of the main cabinet 1 and is disposed at one edge portion of the main cabinet 1 so as to be opened and closed. The front surface of the outer door 2 is provided with elements required for vending product such as a display window, a product selection button, a bill input port, a coin input port, a return lever, a built-in display, a coin return port, and a product output port 2*a*. The inner door 3 is a heat-insulating door which is divided into upper and lower parts to cover the front opening of the product storage 4, an upper heat-insulating door 3*a* is disposed at a position inside the outer door 2 at one edge portion of the outer door 2 so as to be opened and closed, and a lower heat-insulating door 3*b* is disposed at one edge portion of the main cabinet 1 so as to be opened and closed. A product discharge port 3*c* for discharging a product to the outside of the product storage 4 is disposed in a lower part of the lower heat-insulating door 3*b* of the inner door 3.

In the vending machine, a product chute 5 is disposed in the product storage 4, a temperature control unit 6 is disposed in an area below the product chute 5 (hereinafter, also referred to as a "heat exchange area"), and a product storage rack 10 is disposed in an area above the product chute 5 (hereinafter, also referred to as a "product storage area").

The product chute 5 is a plate-like member that guides a product discharged from the product storage rack 10 to the product discharge port 3*c* of the inner door 3 and is disposed to be gradually inclined downward toward the front side. Although not clearly illustrated in the drawing, plural vent holes (not illustrated) causing the heat exchange area and the product storage area to communicate with each other are formed in the product chute 5.

The temperature control unit 6 serves to maintain the internal atmosphere of the product storage 4 in a desired temperature state and includes an evaporator 6*a*, an electric heater 6*b*, and a blower fan 6*c* of a refrigeration cycle. In the temperature control unit 6, for example, when the blower fan 6*c* is driven in a state in which the refrigeration cycle operates, air cooled in the evaporator 6*a* is supplied upward through the vent holes of the product chute 5 and thus the product storage area can be maintained in a low-temperature state. On the other hand, when the blower fan 6*c* is driven in a state in which power is supplied to the electric heater 6*b*, air heated by the electric heater 6*b* is supplied upward through the vent holes of the product chute 5 and thus the product storage area can be maintained in a high-temperature state. Although not clearly illustrated in the drawing, a compressor, a condenser, and an expansion valve of the refrigeration cycle are all disposed in a machine room 7 outside the product storage 4.

The product storage racks 10 are arranged in three lines in the front-rear direction, includes plural (two in the illustrated example) product storage passages 13 which are disposed in a meandering shape in the vertical direction by disposing passage elements 12 between a pair of base side plates 11, and stores plural products with a sideways posture in the vertical direction in the product storage passages 13. More specifically, the passage elements 12 are appropriately disposed on the front side and the rear side of the product storage passages 13 so as to face each other and are fixed to the base side plate 11. Accordingly, in each product storage rack 10, two product storage passages 13 are disposed to be adjacent to each other in the front-rear direction. In the following description, the front product storage passage 13 in one product storage rack 10 is also referred to as a first product storage passage 13*a* and the rear product storage passage 13 is also referred to as a second product storage passage 13*b*.

The passage elements 12 are provided with flappers which are not clearly illustrated in the drawing. The flappers are swingably disposed in the passage elements 12 so as to move forward to and backward from the product storage passage 13. The flappers are biased by coil springs (not illustrated) and moves forward to the product storage passages 13 in a normal state. The flapper moves backward along the meandering product storage passage 13 against a bias force of the coil spring to correct the posture of a product by coming in contact with the product passing through the product storage passage 13.

In the product storage rack 10, a top tray 14 is disposed in the top of the product storage passage 13 and a product dispensing system 20 is disposed in the bottom of the product storage passage 13.

The top tray 14 is formed by bending a plate-like metal sheet, and the top tray is disposed between the base side plates 11 so as to be gradually inclined downward from the front side to the rear side. The top surface of the top tray 14 constitutes a product guide passage 15 that guides a product input through an input port to the product storage passage 13.

Figure 2:
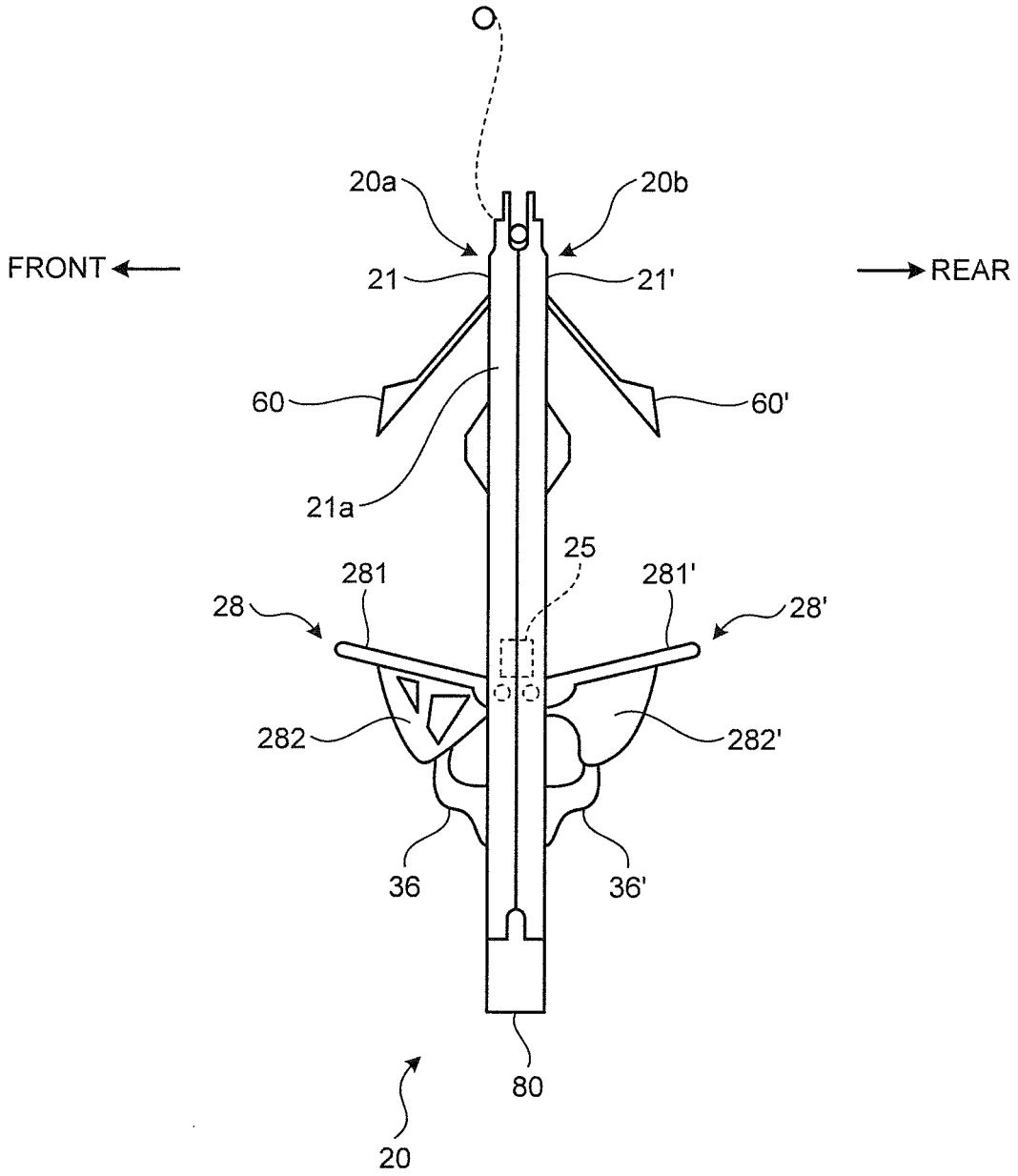
FIG. 2 is a side view schematically illustrating the product dispensing system illustrated in FIG. 1 when viewed from the right side.
Figure 3:
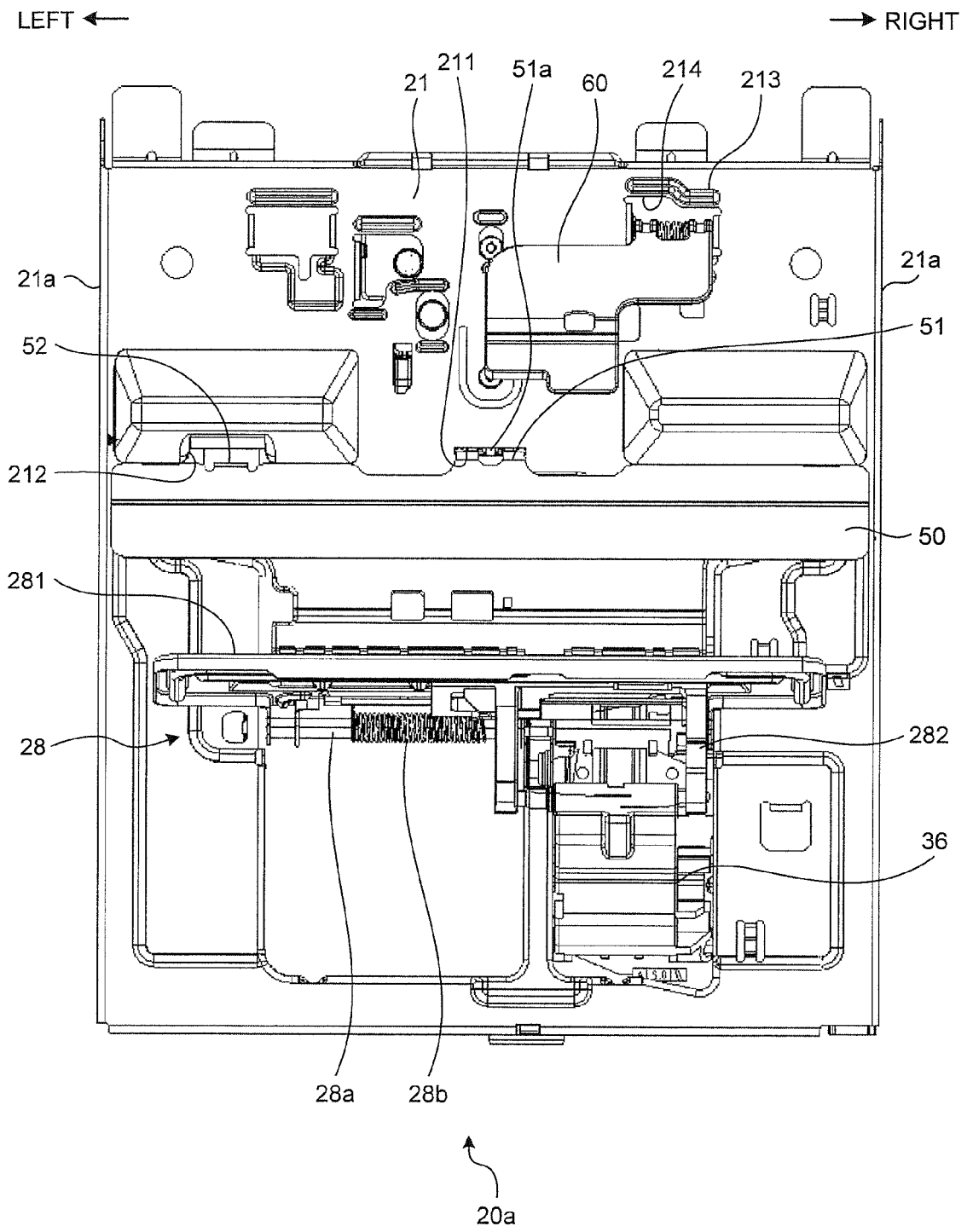
FIG. 3 is a front view of a first product discharging device illustrated in FIG. 1.
Figure 4:
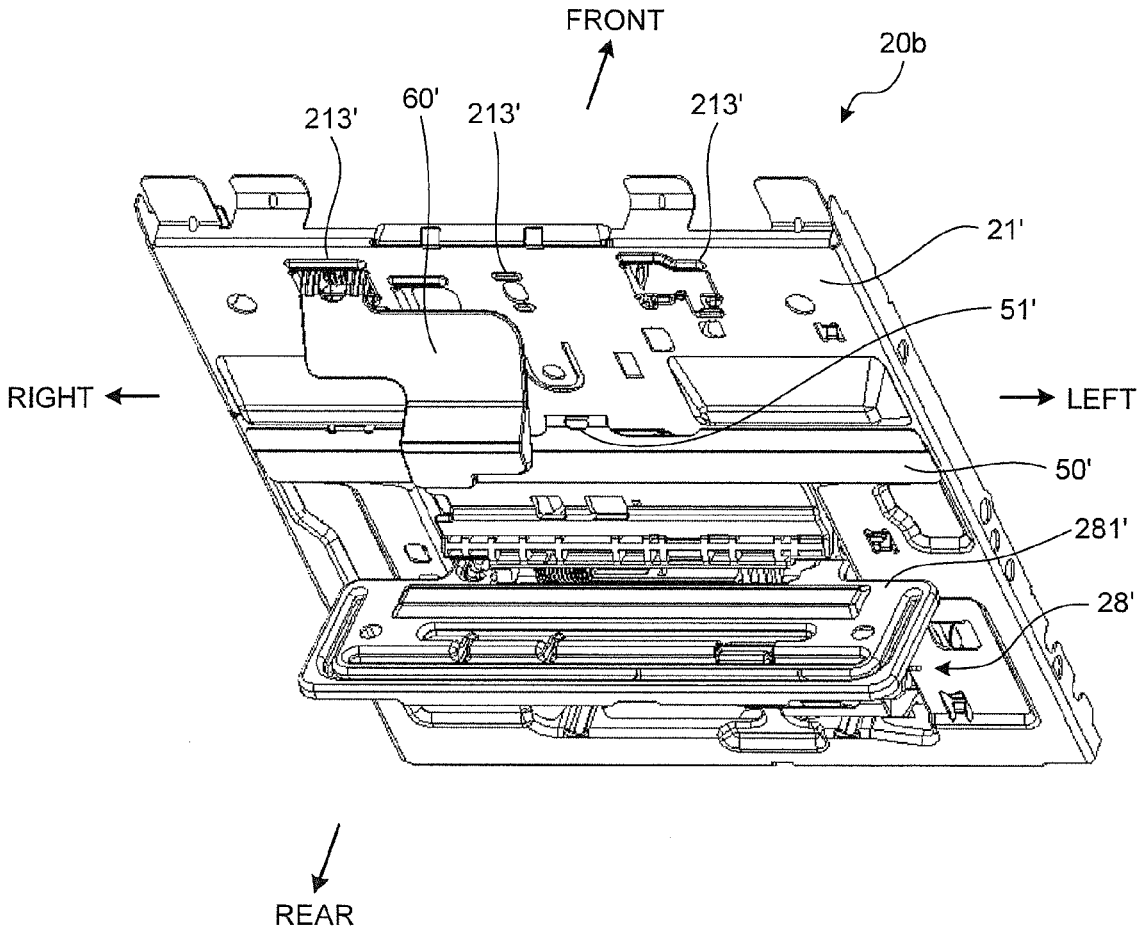
FIG. 4 is a perspective view of a second product discharging device illustrated in FIG. 1.

FIGS. 2 to 4 illustrate a product dispensing system illustrated in FIG. 1, where FIG. 2 is a side view, schematically illustrated, when viewed from the right side, FIG. 3 is a front view when viewed from the front side, and FIG. 4 is a perspective view when viewed from the rear-left side.

As illustrated in FIGS. 2 to 4, the product dispensing system 20 includes one product discharging device (hereinafter, also referred to as a first product discharging device) 20*a* and the other product discharging device (hereinafter, also referred to as a second product discharging device) 20*b*, where the first product discharging device 20*a* and the second product discharging device 20*b* are coupled to each other back to back and a wiring cover 80 is attached thereto. FIGS. 2 to 4 illustrate a state in which the first product discharging device 20*a* and the second product discharging device 20*b* constituting the product dispensing system 20 store no product.

Figure 5:
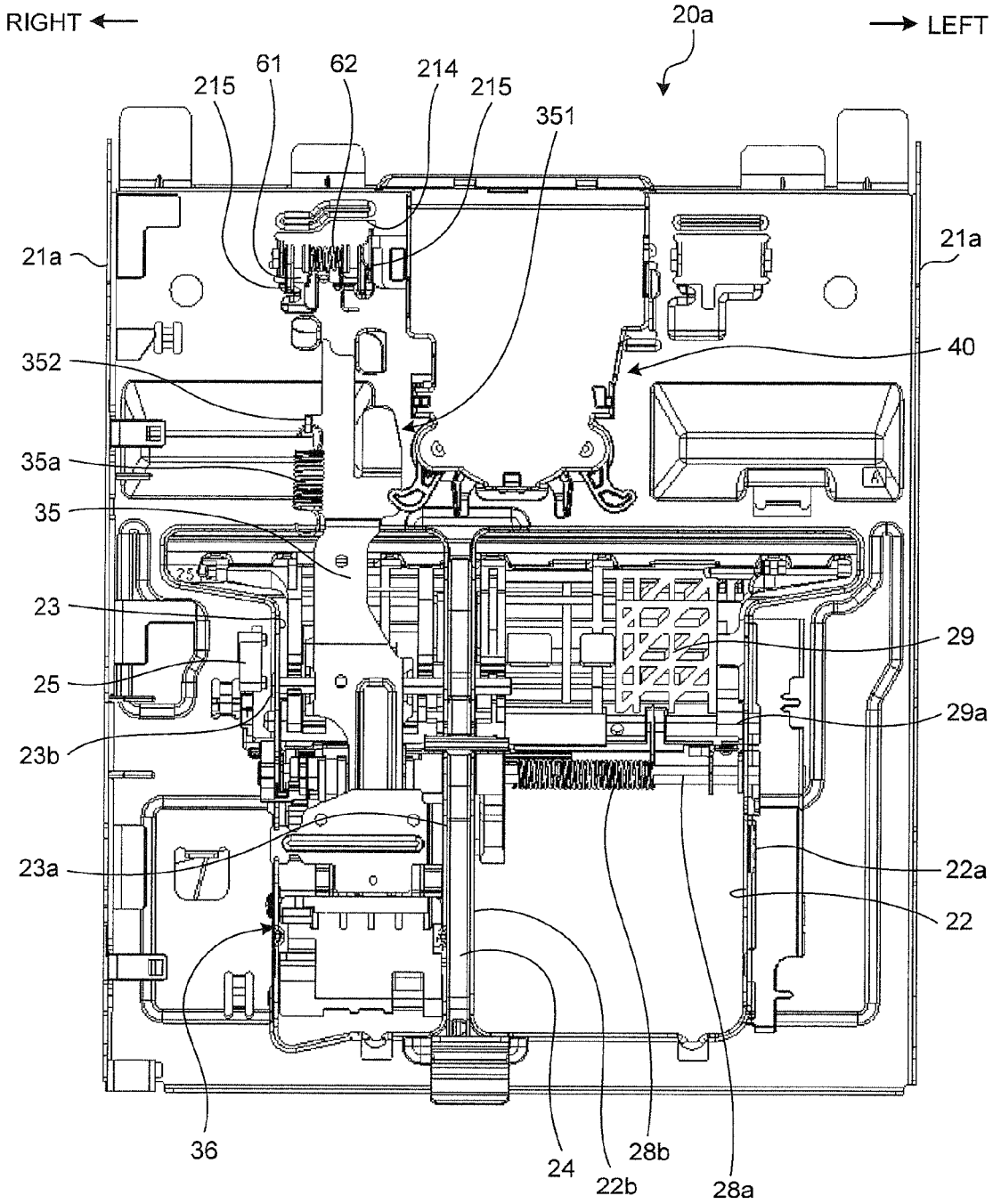
FIG. 5 is a rear view of the first product discharging device illustrated in FIG. 3.

FIG. 5 is a rear view of the first product discharging device 20*a* illustrated in FIGS. 2 and 3. In the following description, the configuration of the first product discharging device 20*a* will be first described and then the second product discharging device 20*b* and the wiring cover 80 will be described.

Figure 6:
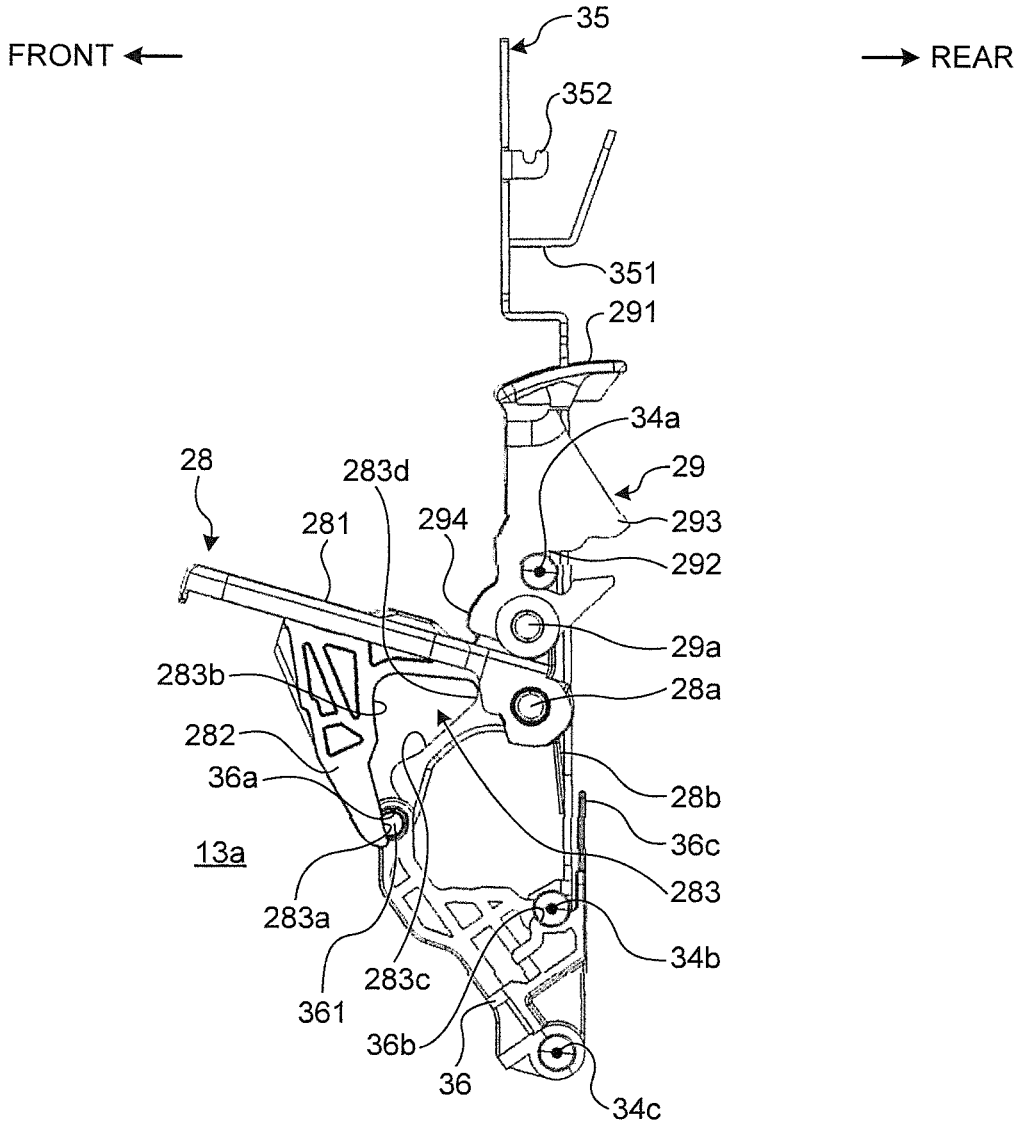
FIG. 6 is a diagram schematically illustrating a principal part of the first product discharging device when viewed from the right side.
Figure 7:
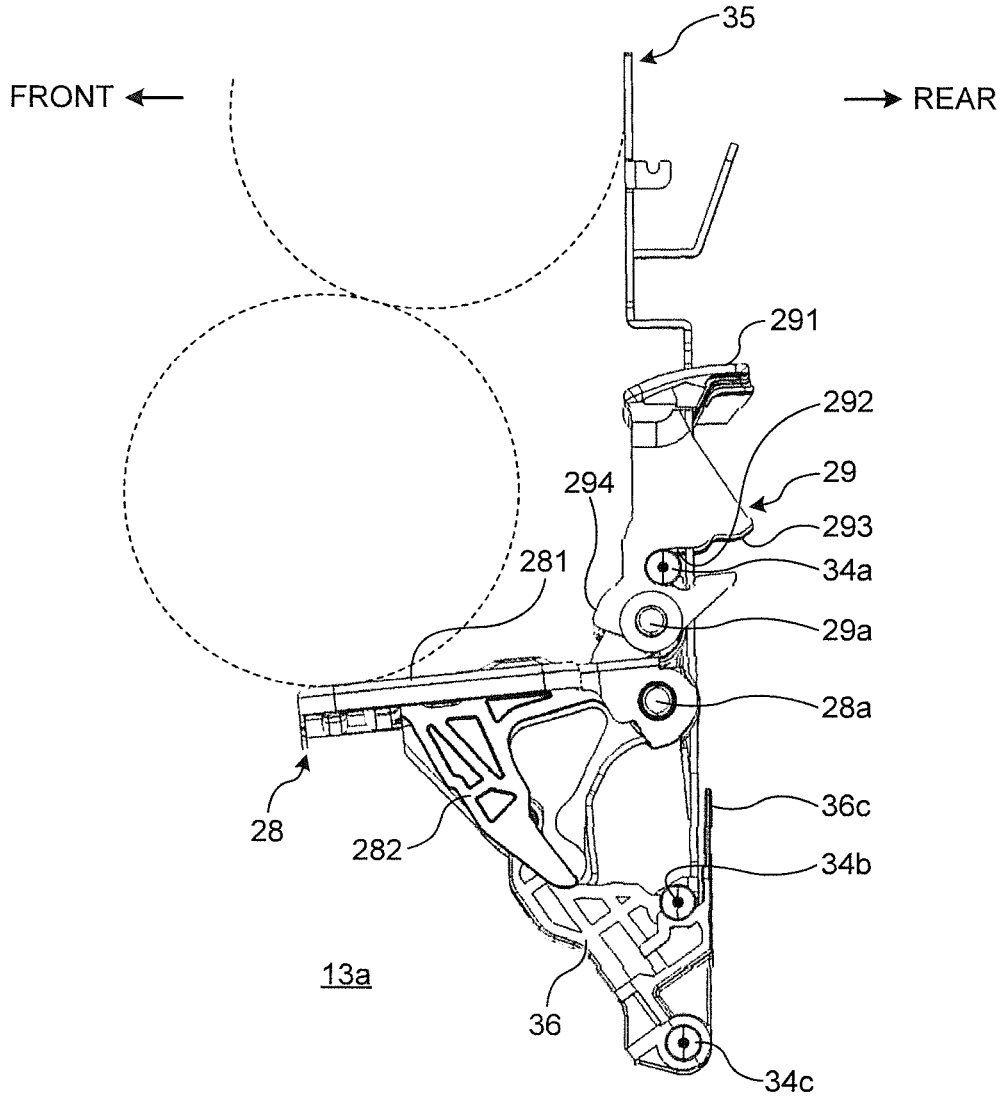
FIG. 7 is a diagram schematically illustrating a principal part of the first product discharging device when viewed from the right side.
Figure 8:
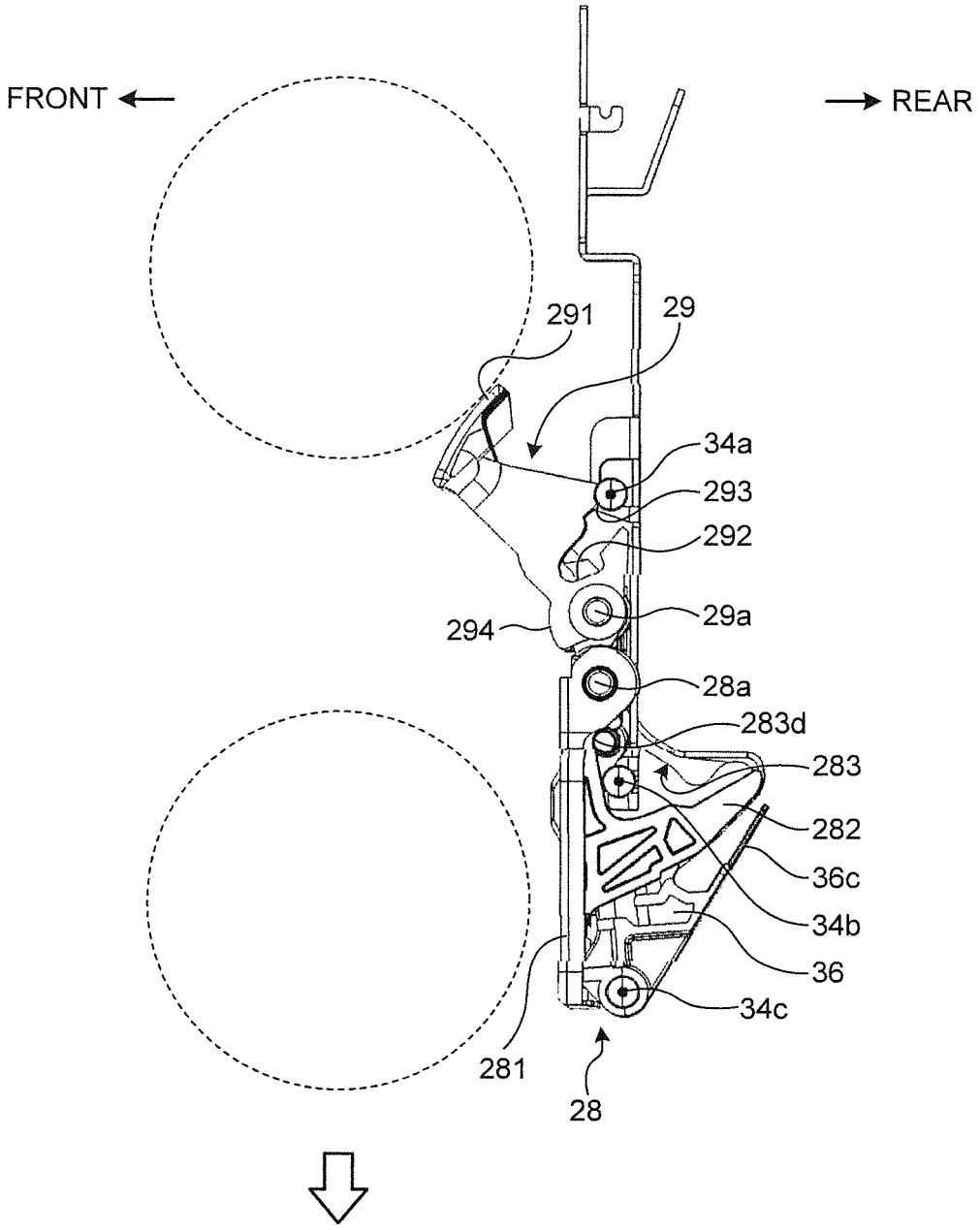
FIG. 8 is a diagram schematically illustrating a principal part of the first product discharging device when viewed from the right side.

FIGS. 6 to 8 are diagrams schematically illustrating principal parts of the first product discharging device 20*a* when viewed from the right side. In the following description, the configuration of the first product discharging device 20*a* will be described appropriately with reference to FIGS. 6 to 8.

The first product discharging device 20*a* is applied to the first product storage passage 13*a* and is disposed in the bottom of the first product storage passage 13*a*. The first product discharging device 20*a* serves to store products in the first product storage passage 13*a* in a standby state and to discharge a product to the product chute 5 in an activated state by controlling behavior of product between an opposite passage width defining plate 16 and the first product discharging device, and includes a base 21.

The base 21 is formed by performing a cutting process and a bending process on a steel sheet and is disposed to cause its own surface to face the passage width defining plate 16. A side wall 21*a* of the base 21 is formed by bending both sides of the base and a first insertion hole 22 and a second insertion hole 23 are formed in an intermediate portion thereof. The circumferential edges of the first insertion hole 22 and the second insertion hole 23 are bent similarly to the side wall 21*a* to form a flange.

The first insertion hole 22 and the second insertion hole 23 are arranged in the right-left direction and have the same size in the vertical direction. Among the first insertion hole 22 and the second insertion hole 23, the first insertion hole 22 is located on the left side of the second insertion hole 23, and the width in the right-left direction of the first insertion hole 22 is larger than the width in the right-left direction of the second insertion hole 23. The first insertion hole 22 and the second insertion hole 23 are through-openings (concave portions for enabling a lower pedal 28 and an upper pedal 29 to be described later to move backward into the base 21) having a substantially rectangular shape as a whole, the top end of the first insertion hole 22 protrudes to the left side, and the top end of the second insertion hole 23 protrudes to the right side.

A first left bearing piece 22*a* is disposed at the left edge portion of the first insertion hole 22, a first right bearing piece 22*b* is disposed at the right edge portion of the first insertion hole 22, a second left bearing piece 23*a* is disposed at the left edge portion of the second insertion hole 23, and a second right bearing piece 23*b* is disposed at the right edge portion of the second insertion hole 23. The first left bearing piece 22*a* and the second right bearing piece 23*b* correspond to the flange formed at the circumferential edges of the first insertion hole 22 and the second insertion hole 23. The first right bearing piece 22*b* and the second left bearing piece 23*a* are formed integrally with the base 21 in which a bearing portion 24 to be described later is fitted and supported and are formed in shaft insertion flanges forming both U-shaped leg portions in a bearing support portion formed in a U-shaped cross-section (discontinuous). The bearing support portion has a function of maintaining the strength of the base 21 even when a large through-opening including the first insertion hole 22 and the second insertion hole 23 which form a substantially rectangular shape as a whole is formed in the base 21.

The bearing portion 24 and a sold-out detection switch 25 are attached to the base 21 having the above-mentioned configuration. The bearing portion 24 is formed of a resin material or the like and is interposed between the first right bearing piece 22*b* and the second left bearing piece 23*a*.

Figure 9:
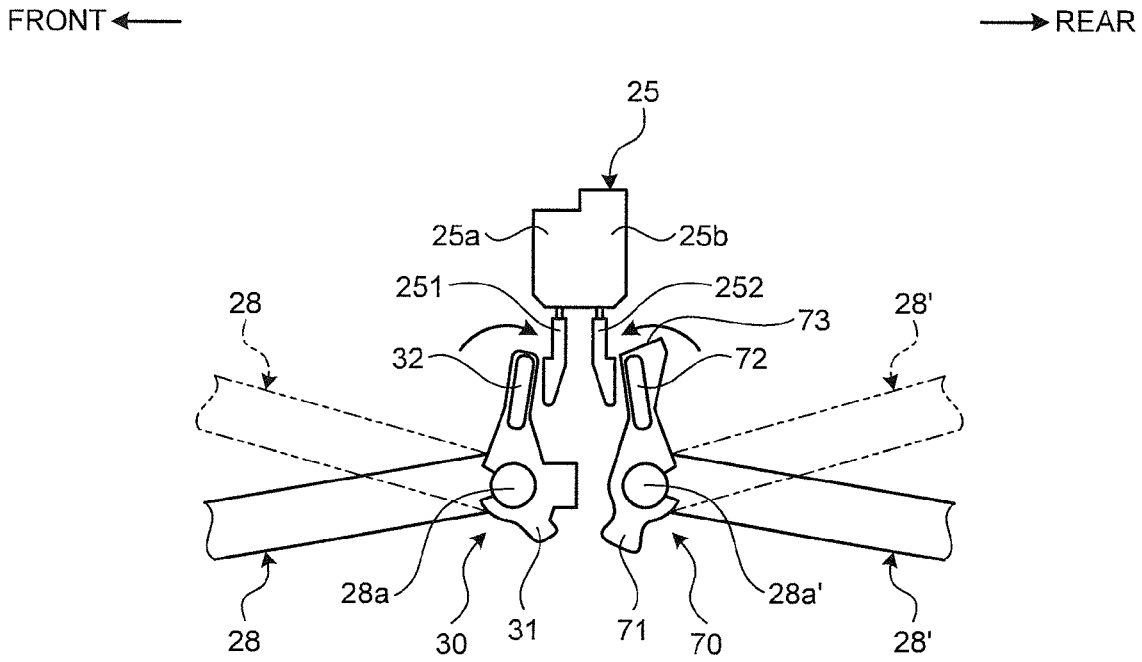
FIG. 9 is a diagram illustrating a principal part of the product dispensing system.

In the sold-out detection switch 25, as illustrated in FIG. 9, a first sold-out detection unit 25*a* and a second sold-out detection unit 25*b* are integrally disposed to be arranged in the front-rear direction. The sold-out detection switch 25 is a so-called push type switch and includes two contactors 251 and 252 that are biased to rise upright by a spring not illustrated. The sold-out detection switch 25 is switched to an OFF state to output an OFF signal when the first contactor 251 and the second contactor 252 are not pressed as illustrated in (a) of FIG. 10 and is switched to an ON state to output an ON signal when one of the first contactor 251 and the second contactor 252 is pressed and displaced against the biasing force of the spring as illustrated in (b) or (c) of FIG. 10. In this embodiment, the sold-out detection switch 25 is switched to the OFF state when the first contactor 251 and the second contactor 252 are not pressed and is switched to the ON state when one of the first contactor 251 and the second contactor 252 is pressed and displaced, but in the present disclosure, the sold-out detection switch may be switched to the ON state when the first contactor and the second contactor are not pressed and may be switched to the OFF state when the first contactor and the second contactor are pressed and displaced.

The base 21 is provided with a first swing support shaft 28*a* and a second swing support shaft 29*a*. The first swing support shaft 28*a* is an axial member which is disposed to extend substantially in the horizontal direction and to penetrate through-holes formed in the base 21 or the bearing portion 24, and supports the lower pedal 28 in the middle way thereof.

A first sold-out link 30 is disposed at the right end of the first swing support shaft 28*a*. As illustrated in FIG. 9, the first sold-out link 30 includes a first sold-out base portion 31 and a first sold-out pressing portion 32. The first sold-out base portion 31 is a deformed portion in which a penetration portion penetrated by the right end of the first swing support shaft 28*a* is formed. The first sold-out pressing portion 32 protrudes to the right side from the top of the first sold-out base portion 31 and extends upward. The penetration portion formed in the first sold-out base portion 31 is formed to be larger than the first swing support shaft 28*a* and is configured such that the first sold-out link 30 can freely move relative to the first swing support shaft 28*a*.

The second swing support shaft 29*a* is an axial member disposed to penetrate the through-holes formed in the base 21 and the bearing portion 24 so as to extend substantially in the horizontal direction in an area above the first swing support shaft 28*a*, and supports the upper pedal 29 in the middle way thereof.

The lower pedal 28 is a plate-like member and is disposed to be swingable about the central axis of the first swing support shaft 28*a* by inserting the first swing support shaft 28*a* into the base end thereof.

The tip portion of the lower pedal 28 extends in an outer radial direction of the first swing support shaft 28*a*, and can move forward to and backward from the first product storage passage 13*a* via the first insertion hole 22 and the second insertion hole 23 when the lower pedal swings about the central axis of the first swing support shaft 28*a*. That is, the lower pedal 28 is swingably disposed to move forward to and backward from the first product storage passage 13*a*.

A lower pedal spring 28*b* is interposed between the lower pedal 28 and the base 21. The lower pedal spring 28*b* normally biases the lower pedal 28 in the forward moving direction to the first product storage passage 13*a*. More specifically, the lower pedal spring 28*b* causes the lower pedal 28 to take a standby posture (hereinafter, also referred to as a product-absent standby posture) such that the tip portion of the lower pedal 28 is located higher than the first swing support shaft 28*a* as illustrated in FIG. 6. When product is placed on the top surface of the lower pedal 28, the lower pedal spring 28*b* causes the lower pedal 28 to take a standby posture (hereinafter, also referred to as a product-present standby posture) such that the tip portion of the lower pedal 28 is located at the same height level as the first swing support shaft 28*a* as illustrated in FIG. 7.

Accordingly, in the product-absent standby posture, the tip portion of the lower pedal 28 is located higher than in the product-present standby posture.

When the lower pedal 28 takes the product-absent standby posture, the base end of the lower pedal 28 comes in contact with a contact portion (not illustrated) disposed in the first sold-out base portion 31 in the first sold-out link 30 as indicated by a two-dot chained line in FIG. 9, thus the first sold-out link 30 rotates about the first swing support shaft 28*a*, and thus the first sold-out pressing portion 32 presses the first contactor 251 of the sold-out detection switch 25. Accordingly, in the sold-out detection switch 25, the first contactor 251 is pressed and displaced backward against the biasing force of the spring and is switched to the ON state, and thus an ON signal is output to the control unit.

On the other hand, when the lower pedal 28 takes the product-present standby posture, the base end of the lower pedal 28 is separated from the contact portion of the first sold-out link 30 and thus the first sold-out link 30 is switched to a free state as indicated by a solid line in FIG. 9. Accordingly, in the sold-out detection switch 25, the first contactor 251 is biased by the spring to rise upright and is switched to the OFF state, and thus an OFF signal is output to the control unit. That is, the first sold-out link 30 switched to the free state rotates about the first swing support shaft 28*a* by pressing the first sold-out pressing portion 32 against the first contactor 251.

The lower pedal 28 includes a plate-like pedal body 281 and a pair of guide portions 282. The pair of guide portions 282 is disposed on the rear side of the pedal body 281. Each guide portion 282 is a plate-like member extending in the vertical direction and both guide portions are formed to face each other. A guide groove 283 is formed on the facing surfaces of the guide portions 282.

The guide groove 283 includes a fitting portion 283*a* which is located at the lowest position in a state in which the lower pedal 28 is disposed at a forward-moved position at which the lower pedal most moves forward to the first product storage passage 13*a* (the state illustrated in FIG. 6) and into which a pedal operating shaft 361 of a rotation stopper 36 to be described later is fitted, a contact portion 283*d* which is located at the highest position in a state in which the lower pedal 28 is disposed at a backward-moved position at which the lower pedal most moves backward from the first product storage passage 13*a* (the state illustrated in FIG. 8) and with which the pedal operating shaft 361 of the rotation stopper 36 comes in contact, and a first guide portion 283*b* and a second guide portion 283*c* which are continuously connected to the fitting portion 283*a* and the contact portion 283*d*.

The first guide portion 283*b* is formed in the guide portion 282 to be inclined obliquely upward from the fitting portion 283*a* so as to get away from the base 21, be inclined obliquely upward so as to get close to the base 21, and then reach the contact portion 283*d* in a state in which the lower pedal 28 is located at the position (forward-moved position) at which the lower pedal most moves forward to the first product storage passage 13*a*.

The second guide portion 283*c* is formed in the guide portion 282 to be inclined obliquely downward from the contact portion 283*d* so as to get away from the base 21 and then reach the fitting portion 283*a* in a state in which the lower pedal 28 is located at the position (forward-moved position) at which the lower pedal most moves forward to the first product storage passage 13*a*.

The length in the outer radial direction of the lower pedal 28 from the first swing support shaft 28*a* is set to a length with which a gap smaller than the maximum width of a product having a small maximum width can be secured between the passage width defining plate 16 and the lower pedal when the lower pedal is located at the position (forward-moved position) at which the lower pedal most moves forward to the first product storage passage 13*a*.

The upper pedal 29 is a plate-like member and is disposed in the base 21 so as to be swingable about the central axis of the second swing support shaft 29*a* by inserting the second swing support shaft 29*a* into the base end thereof.

The tip portion of the upper pedal 29 extends in an outer radial direction of the second swing support shaft 29*a*, and can move forward to and backward from the first product storage passage 13*a* via the first insertion hole 22 and the second insertion hole 23 when the upper pedal swings about the central axis of the second swing support shaft 29*a*. That is, the upper pedal 29 is swingably disposed to move forward to and backward from the first product storage passage 13*a*.

An upper pedal spring (not illustrated) is interposed between the upper pedal 29 and the base 21. The upper pedal spring normally biases the upper pedal 29 in the backward moving direction to the first product storage passage 13*a*.

The upper pedal 29 is provided with a pressing inclined surface 291, a concave portion 292, a stopper contact portion 293, and a protrusion 294. The pressing inclined surface 291 is disposed in the tip portion of the upper pedal 29 and is a curved inclined surface which is formed to be gradually lowered toward the first product storage passage 13*a* when the upper pedal 29 moves backward from the first product storage passage 13*a*. The concave portion 292 is disposed on the rear side of the upper pedal 29 and is a set of concave places extending substantially in the horizontal direction and being formed to be opened to both side surfaces of the upper pedal 29. The stopper contact portion 293 is a portion with which a stopper pin 34*a* to be described later comes in contact and is disposed to be inclined to the upper side of the concave portion 292 on the rear surface of the upper pedal 29.

The protrusion 294 is disposed at the base end of the upper pedal 29 so as to protrude toward the first product storage passage 13*a*.

The upper pedal 29 is biased to move backward from the first product storage passage 13*a* by a biasing force of the upper pedal spring, but the initial position thereof is set in a state in which the upper pedal moves backward from the first product storage passage 13*a* by bringing the stopper pin 34*a* into contact with the concave portion 292.

The upper pedal 29 is inclined to the front side with respect to the vertical plane passing through the second swing support shaft 29*a* in a state (the state illustrated in FIG. 8) in which the upper pedal is located at the position (forward-moved position) at which the upper pedal most moves forward to the first product storage passage 13*a*. The length in the outer radial direction of the upper pedal 29 from the second swing support shaft 29*a* is set to a length with which a gap smaller than the maximum width of a product having a small maximum width can be secured between the passage width defining plate 16 and the upper pedal in the state in which the upper pedal is inclined to the front side.

In the base 21, the stopper pin 34*a*, a pedal stopper pin 34*b*, and a stopper shaft 34*c* are disposed between the bearing portion 24 and the second right bearing piece 23*b*.

The stopper pin 34*a* is an axial member which is disposed substantially in the horizontal direction between the bearing portion 24 and the second right bearing piece 23*b*. The stopper pin 34*a* is coupled to a pedal link 35 and is movable in the vertical direction with the movement in the vertical direction of the pedal link 35. The stopper pin 34*a* comes in contact with the concave portion 292 of the upper pedal 29 located at the initial position.

The pedal stopper pin 34*b* is an axial member which is disposed substantially in the horizontal direction between the bearing portion 24 and the second right bearing piece 23*b*. The pedal stopper pin 34*b* is coupled to the pedal link 35 and is movable in the vertical direction with the movement in the vertical direction of the pedal link 35.

The stopper shaft 34*c* is an axial member which is disposed substantially in the horizontal direction between the bearing portion 24 and the second right bearing piece 23*b*. The stopper shaft 34*c* supports the rotation stopper 36 in the middle way thereof.

The rotation stopper 36 is disposed between the bearing portion 24 and the second right bearing piece 23*b* so as to insert the stopper shaft 34*c* into the insertion hole of the base end thereof and to be swingable about the central axis of the stopper shaft 34*c*.

The tip portion of the rotation stopper 36 extends in the outer radial direction of the stopper shaft 34*c* and is movable forward to and backward from the first product storage passage 13*a* via the second insertion hole 23 when the rotation stopper swings about the central axis of the stopper shaft 34*c*.

The rotation stopper 36 includes a pedal operating shaft 361 so as to insert the pedal operating shaft 361 into a through-hole 36*a* of the tip portion thereof. The pedal operating shaft 361 is an axial member which is disposed substantially in the horizontal direction and both ends thereof are fitted into the guide grooves 283 of the lower pedal 28.

A pedal operating spring (not illustrated) is interposed between the rotation stopper 36 and the base 21. The pedal operating spring normally biases the rotation stopper 36 in the forward moving direction to the first product storage passage 13*a*.

The rotation stopper 36 is biased in the forward moving direction to the first product storage passage 13*a* by the pedal operating spring, movement in the backward moving direction thereof is regulated by moving the pedal stopper pin 34*b* into a recessed portion 36*b* of the rotation stopper 36 to come in contact with the pedal stopper pin 34*b*, and the initial position thereof in the state in which the rotation stopper moves forward to the first product storage passage 13*a* is set. Since the lower pedal 28 is biased by the lower pedal spring 28*b*, the initial position of the rotation stopper 36 is set to a position at which both ends of the pedal operating shaft 361 are located in the fitting portion 283*a* of the guide grooves 283 and the lower pedal 28 moves forward to the first product storage passage 13*a*.

Figure 11:
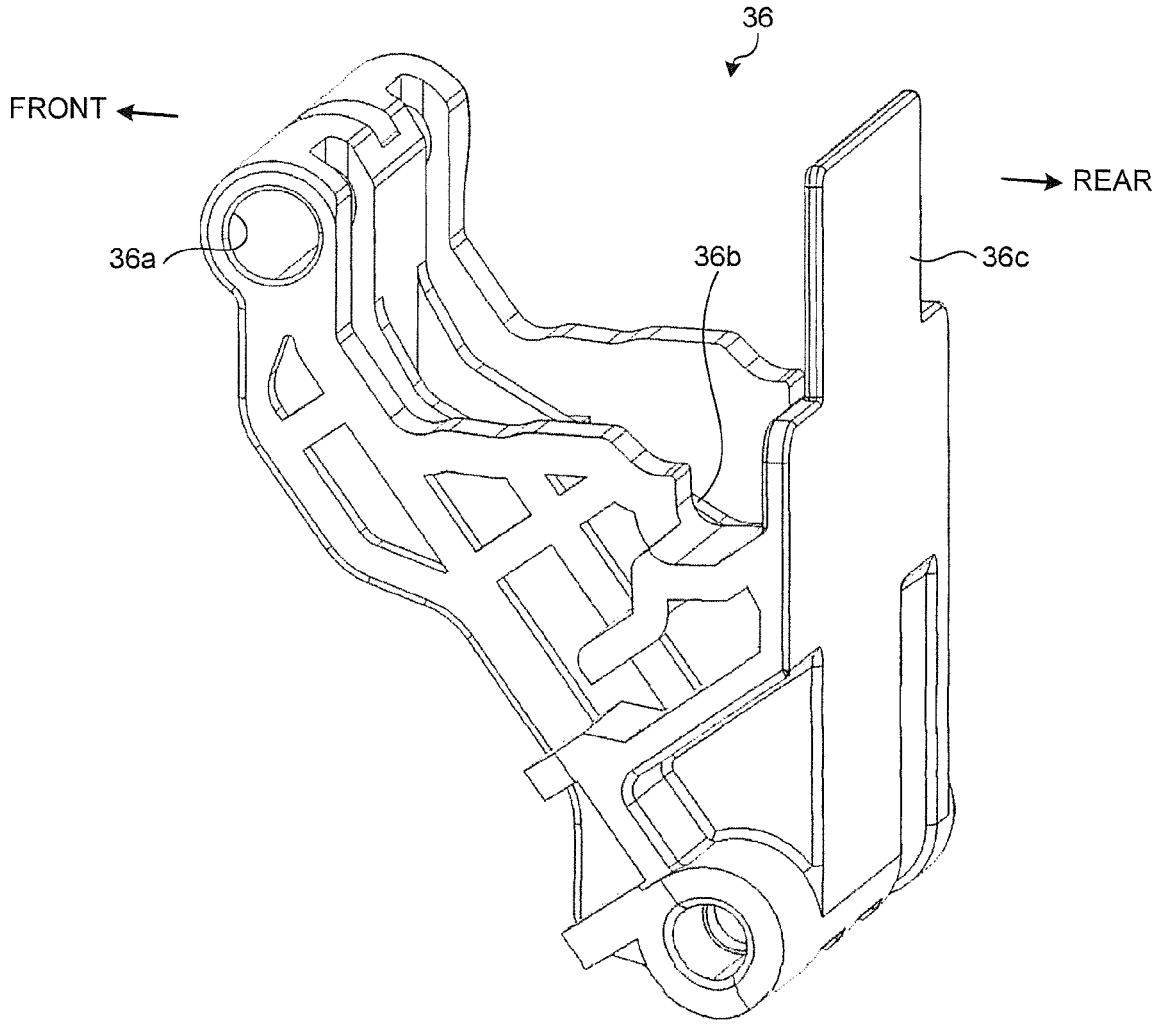
FIG. 11 is a perspective view of a rotation stopper constituting the first product discharging device.

As illustrated in FIG. 11, the rotation stopper 36 is provided with a panel-like blindfold portion 36*c* extending upward on the rear side thereof, that is, on the rear side of the recessed portion 36*b*. The blindfold portion 36*c* covers a part of the pedal stopper pin 34*b* opposite to the first product storage passage 13*a*. More specifically, the blindfold portion 36*c* covers the part, which is opposite to the first product storage passage 13*a*, of the pedal stopper pin 34*b* moving in the vertical direction.

The pedal link 35 is a long plate-like member extending in the vertical direction and an upper portion thereof is bent to the front side and then extends upward. The upper portion of the pedal link 35 is provided with a contact piece 351 extending backward and then extending obliquely upward and a locking portion 352 locking a link spring 35*a*. The link spring 35*a* is interposed between the pedal link 35 and the base 21 and normally biases the pedal link 35 downward.

In a state in which the pedal link 35 is biased by the link spring 35*a* and is located on the lower side, the concave portion 292 of the upper pedal 29 disposed at the backward-moved position comes in contact with the stopper pin 34*a*. The rotation stopper 36 disposed at the forward-moved position comes in contact with the pedal stopper pin 34*b* to regulate the backward movement of the rotation stopper 36. The pedal operating shaft 361 of the rotation stopper 36 disposed at the forward-moved position is fitted into the fitting portion 283*a* of the lower pedal 28 to regulate the backward movement of the lower pedal 28 disposed at the forward-moved position.

On the other hand, in the state in which the pedal link 35 is located on the upper side against the biasing force of the link spring 35*a*, as illustrated in FIG. 8, the stopper contact portion 293 of the upper pedal 29 comes in contact with the stopper pin 34*a* to regulate the backward movement of the upper pedal 29, and the upper pedal 29 moves forward against the biasing force of the upper pedal spring and is disposed at the forward-moved position.

On the other hand, since the regulation of the backward movement due to the pedal stopper pin 34*b* is released, the regulation of the backward movement of the rotation stopper 36 with respect to the stopper shaft 34*c* is released. Here, the weight of a product coming in contact with the lower pedal 28 maintained at the forward-moved position by the rotation stopper 36 is applied to the rotation stopper 36, and the rotation stopper 36 starts its backward movement with releasing the regulation of the backward movement of the rotation stopper 36. When the backward movement of the rotation stopper 36 is started, the pedal operating shaft 361 departs from the fitting portion 283*a* of the lower pedal 28. Accordingly, the lower pedal 28 is allowed to move backward about the first swing support shaft 28*a* and moves backward against the elastic biasing force of the lower pedal spring 28*b* by the weight of the product (see FIG. 8).

When the lower pedal 28 moves backward in this way, the base end of the lower pedal 28 is separated from a first sold-out contact portion 283*d* of the first sold-out link 30 and thus the first sold-out link 30 is switched to the free state. Accordingly, in the sold-out detection switch 25, the first contactor 251 is biased by the spring to rise upright and thus to maintain the OFF state. That is, when the lower pedal 28 moves backward, similarly to the product-present standby posture, the first sold-out link 30 does not press the first contactor 251 of the sold-out detection switch 25.

The first product discharging device 20*a* having the above-mentioned configuration includes a drive unit 40, a cover flapper 50, and a lever member 60 in addition to the above-mentioned configuration.

Figure 12:
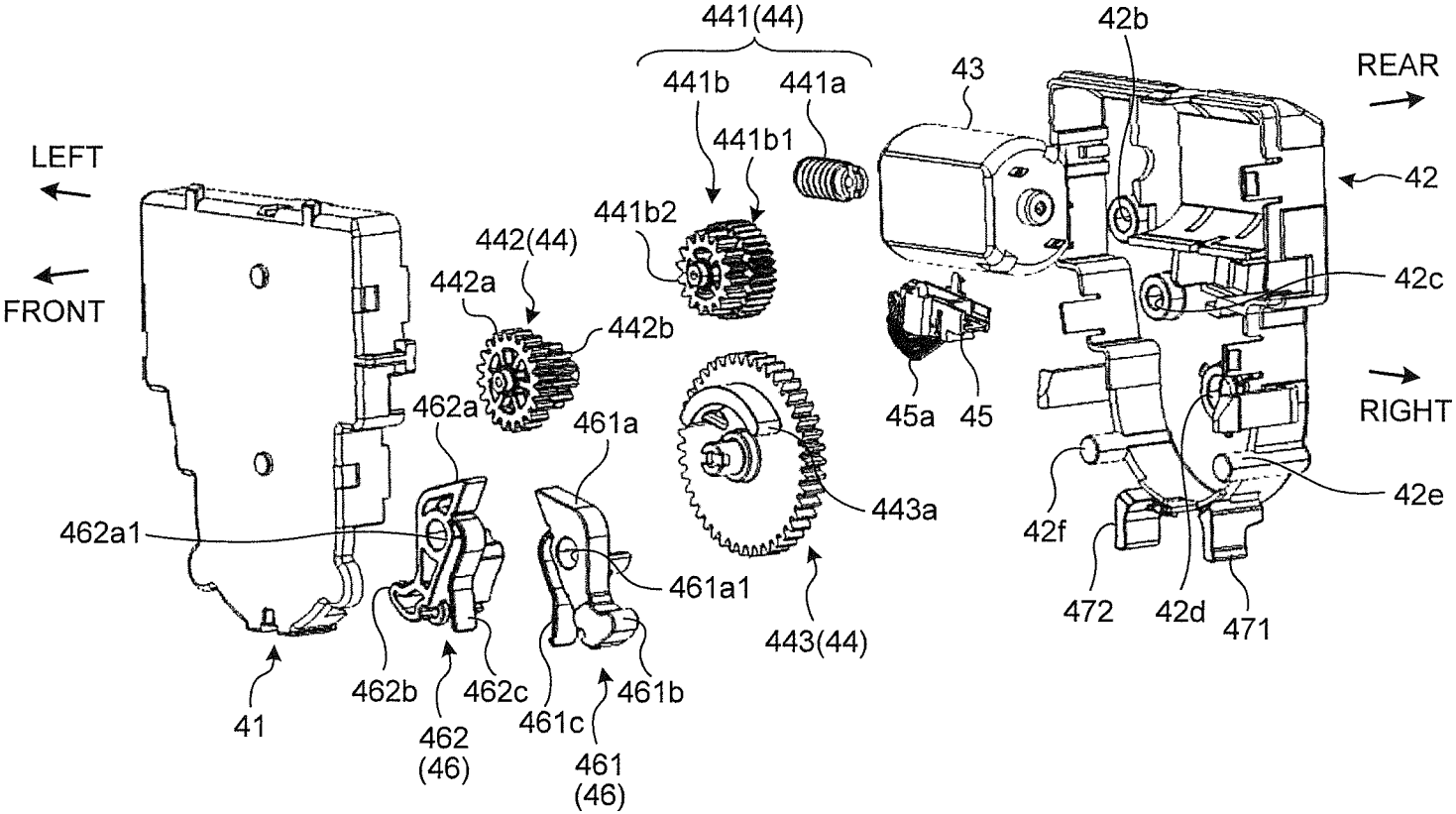
FIG. 12 is an exploded perspective view illustrating principal parts of a drive unit in the first product discharging device when viewed from the front-right side.
Figure 13:
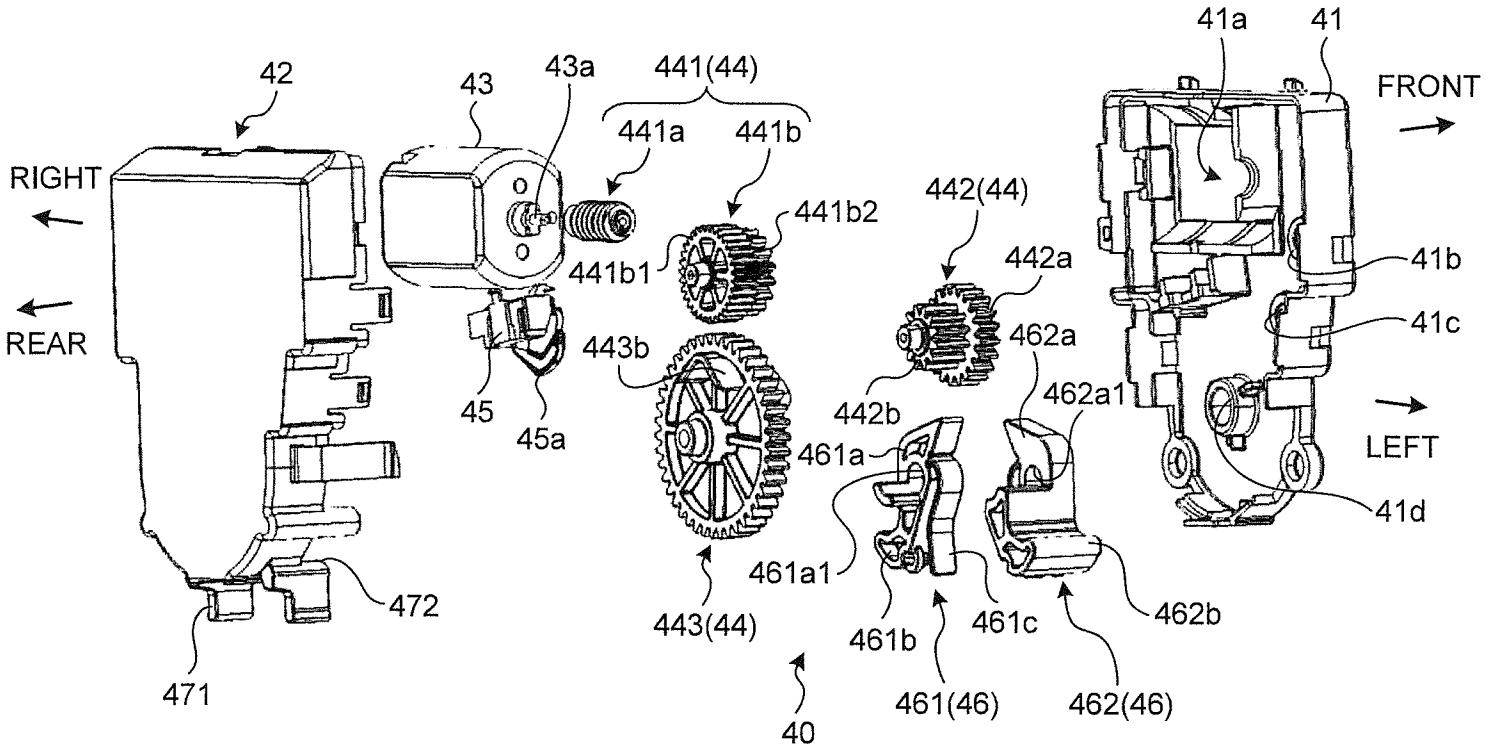
FIG. 13 is an exploded perspective view illustrating principal parts of the drive unit in the first product discharging device when viewed from the rear-left side.

FIGS. 12 and 13 illustrate principal parts of the drive unit 40 in the first product discharging device 20*a*, where FIG. 12 is an exploded perspective view thereof when viewed from the front-right side and FIG. 13 is an exploded perspective view thereof when viewed from the rear-left side.

The drive unit 40 is disposed in an upper center area of the rear side of the base 21. The drive unit 40 includes a unit base 42 which is attached to the rear surface of the base 21.

The unit base 42 is formed of, for example, a resin material and is formed in a box shape of which the rear surface is opened. In the unit base 42, the opening of the rear surface is closed by attaching a unit cover 41 formed of a resin thereto, thereby forming a storage space between the unit base and the unit cover 41. A motor 43, a gear member 44, a carrier switch 45, and a link lever 46 are stored in the storage space formed by the unit base 42 and the unit cover 41.

The motor 43 serves as a drive source and is a DC motor that is rotatable positively and reversely and that is driven in accordance with a command issued from the control unit not illustrated. The motor 43 is disposed in a state in which the motor is held by a motor holding portion 41*a* of the unit base 42.

The gear member 44 includes a worm gear 441, an intermediate gear 442, and an output gear 443. The worm gear 441 includes a worm 441*a* and a worm wheel 441*b*.

The worm 441*a* has a cylindrical shape and is attached to an output shaft 43*a* of the motor 43. The worm wheel 441*b* includes a first worm wheel 441*b*1 having a disk shape and a second worm wheel 441*b*2 having a disk shape.

In the first worm wheel 441*b*1, an axial portion protruding rearward is formed at the center thereof and a gear portion including plural teeth is formed on the circumferential surface thereof.

The second worm wheel 441*b*2 is located on the front side of the first worm wheel 441*b*1 and is formed such that an axial portion of which the central axis matches the central axis of the axial portion of the first worm wheel 441*b*1 protrudes to the front side. A gear portion including plural teeth is also formed on the circumferential surface of the second worm wheel 441*b*2.

The worm wheel 441*b* is disposed to be rotatable about the central axis of the axial portion by inserting the axial portion into concave portions 41*b* and 42*b* of the unit base 42 and the unit cover 41 in a state in which the gear portion of the first worm wheel 441*b*1 engages with the worm 441*a*.

The intermediate gear 442 includes a disk-like first intermediate gear 442*a* and a disk-like second intermediate gear 442*b*. In the first intermediate gear 442*a*, an axial portion protruding to the rear side is formed at the center thereof and a gear portion including plural teeth is formed on the circumferential surface thereof.

The second intermediate gear 442*b* is located on the rear side of the first intermediate gear 442*a* and is disposed such that an axial portion of which the central axis matches the central axis of the axial portion of the first intermediate gear 442*a* protrudes to the front side. A gear portion including plural teeth is also formed on the circumferential surface of the second intermediate gear 442*b*.

The intermediate gear 442 is disposed to be rotatable about the central axis of the axial portion by inserting the axial portion into concave portions 41*c* and 42*c* of the unit base 42 and the unit cover 41 in a state in which the gear portion of the first intermediate gear 442*a* engages with the gear portion of the second worm wheel 441*b*2.

The output gear 443 has a disk shape having a diameter larger than that of the worm wheel 441*b* or the intermediate gear 442. A gear portion including plural teeth is also formed on the circumferential surface of the output gear 443. An axial portion protruding in the front-rear direction is formed at the center of the output gear 443. A cam portion 443*a* is formed on the front surface of the output gear 443 and a pressing piece 443*b* is formed on the rear surface thereof.

The cam portion 443*a* has an arc shape and is formed to protrude to the front side. The cam portion 443*a* is formed such that the length of the arc shape thereof is set to a size sufficient for holding a state in which the pedal link 35 has moved upward.

The pressing piece 443*b* has a substantially V shape and is formed to protrude to the rear side on the rear surface opposite to the cam portion 443*a*.

The output gear 443 is disposed to be rotatable about the central axis of the axial portion by inserting the axial portion into concave portions 41*d* and 42*d* of the unit base 42 and the unit cover 41 in a state in which the gear portion engages with the gear portion of the second intermediate gear 442*b*.

The carrier switch 45 is a so-called push type switch and includes a contactor 45*a*. The carrier switch 45 is disposed in the unit base 42 in a state in which the carrier switch is held slightly above the area in which the output gear 443 is disposed. The carrier switch 45 is switched to an ON state to supply details thereof as an ON signal to the control unit when the contactor 45*a* is pressed, and is switched to an OFF state to supply details thereof as an OFF signal to the control unit when the contactor 45*a* is not pressed.

The link lever 46 includes a first link lever 461 and a second link lever 462. The first link lever 461 is formed of, for example, a resin material and a through-hole 461*a*1 is formed at a base end 461*a* thereof. The first link lever 461 has a hook shape in which a tip portion 461*b* extends obliquely downward to the right side from the base end 461*a* and is then curved obliquely upward to the right side. The base end 461*a* of the first link lever 461 is provided with a locking portion 461*c*. The locking portion 461*c* is a plate-like elastic member which extends downward from the left end of the base end 461*a* and which is elastically deformable.

The first link lever 461 is disposed to be rotatable about the central axis of a first link shaft 42*e* on the front side of the output gear 443 by inserting the first link shaft 42*e* disposed in the unit cover 41 into the through-hole 461*a*1 of the base end 461*a*. In this case, the first link lever 461 penetrates a right opening (not illustrated) formed by the unit base 42 and the unit cover 41 and the tip portion 461*b* is located outside the unit base 42 and the unit cover 41. The posture in the normal state of the first link lever 461 is determined by bringing the locking portion 461*c* into contact with a left edge portion 471 of the right opening.

The second link lever 462 is formed of, for example, a resin material and a through-hole 462*a*1 is formed at a base end 462*a* thereof. The second link lever 462 has a hook shape in which a tip portion 462*b* extends obliquely downward to the left side from the base end 462*a* and is then curved obliquely upward to the left side. The tip portion 462*b* of the second link lever 462 has a width in the front-rear direction larger than that of the tip portion 461*b* of the first link lever 461. The base end 462*a* of the second link lever 462 is provided with a locking portion 462*c*. The locking portion 462*c* is a plate-like elastic member which extends downward from the right end of the base end 462*a* and which is elastically deformable.

The second link lever 462 is disposed to be rotatable about the central axis of a second link shaft 42*f* on the front side of the output gear 443 by inserting the second link shaft 42*f* disposed in the unit cover 41 into the through-hole 462*a*1 of the base end 462*a*. In this case, the second link lever 462 penetrates a left opening (not illustrated) formed by the unit base 42 and the unit cover 41 and the tip portion 461*b* is located outside the unit base 42 and the unit cover 41. The posture in the normal state of the second link lever 462 is determined by bringing the locking portion 462*c* into contact with a right edge portion 472 of the left opening.

Figure 14:
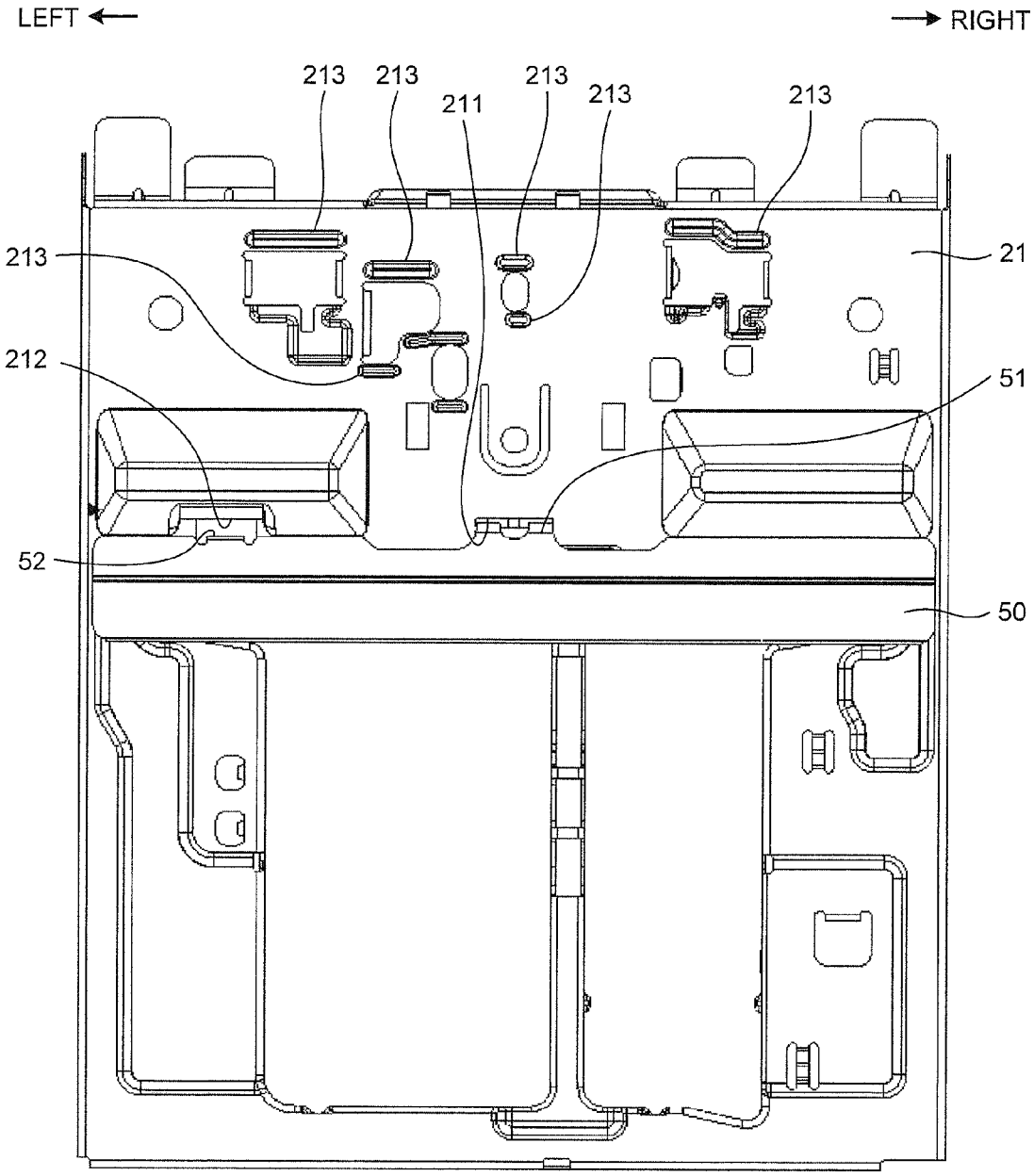
FIG. 14 is a front view of a base of the first product discharging device.
Figure 15:
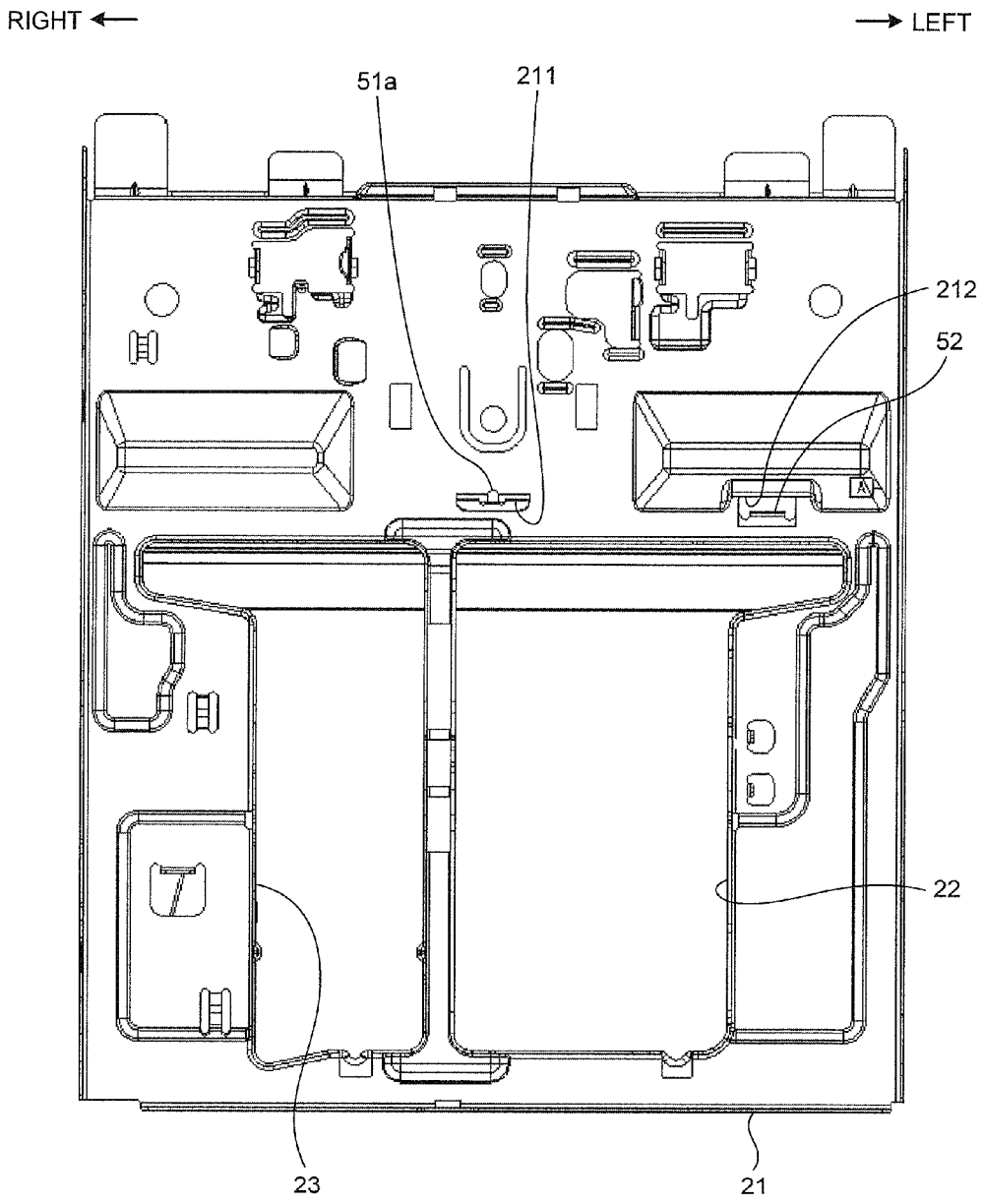
FIG. 15 is a rear view of the base illustrated in FIG. 14.

The cover flapper 50 is a long member which has a width in the right-left direction slightly smaller than that of the base 21 and of which the right-left direction is the length direction thereof as illustrated in FIGS. 14 and 15. In the cover flapper 50, a first tongue-like portion 51 is formed at an upper end of the central portion thereof and a second tongue-like portion 52 is formed on the left side of the first tongue-like portion 51. A cut-raised portion 51*a* is formed in the first tongue-like portion 51.

In the cover flapper 50, the cut-raised portion 51*a* comes in contact with the rear surface of the base 21 by inserting the first tongue-like portion 51 into a first axial support hole 211 formed at the center of the base 21 from the front side, and the cover flapper is disposed to be swingable so as to move forward to and backward from the first product storage passage 13*a* by inserting the second tongue-like portion 52 into a second axial support hole 212 formed on the left side of the base 21 from the front side. The cover flapper 50 is pressed by the upper pedal 29 to move forward when the upper pedal 29 moves forward to the first product storage passage 13*a* and moves backward along with the upper pedal 29 when the upper pedal 29 moves backward from the first product storage passage 13*a*. Here, the second tongue-like portion 52 is inserted into the second axial support hole 212 to regulate the rotational movement of the cover flapper 50 about the first tongue-like portion 51 in the clockwise or counterclockwise direction in a front view.

In an area above the position at which the cover flapper 50 is disposed, that is, in an area above the upper pedal 29, in the base 21 constituting the first product discharging device 20*a*, protrusions 213 protruding to the first product storage passage 13*a* are formed in an upper edge portion and a lower edge portion in the vicinity of plural openings to be formed.

The lever member 60 is swingably disposed to be movable forward to and backward from the first product storage passage 13*a* in a state in which the lever member penetrates a lever opening 214 of the right top end of the base 21. More specifically, a pair of right and left lever locking pieces 215 protruding to the rear side is formed on both edges of the lever opening 214 on the rear side of the base 21, and the lever member 60 is disposed to be swingable about the axis of shaft portions 61 formed in the lever locking pieces 215 as illustrated in FIGS. 3 and 5. A lever spring 62 is interposed between the lever member 60 and the base 21 so as to be wound on the shaft portion 61, and the lever member 60 is biased by the lever spring 62 and takes a posture in which the tip portion 461*b* moves forward to the first product storage passage 13*a* in a normal state.

Figure 16:
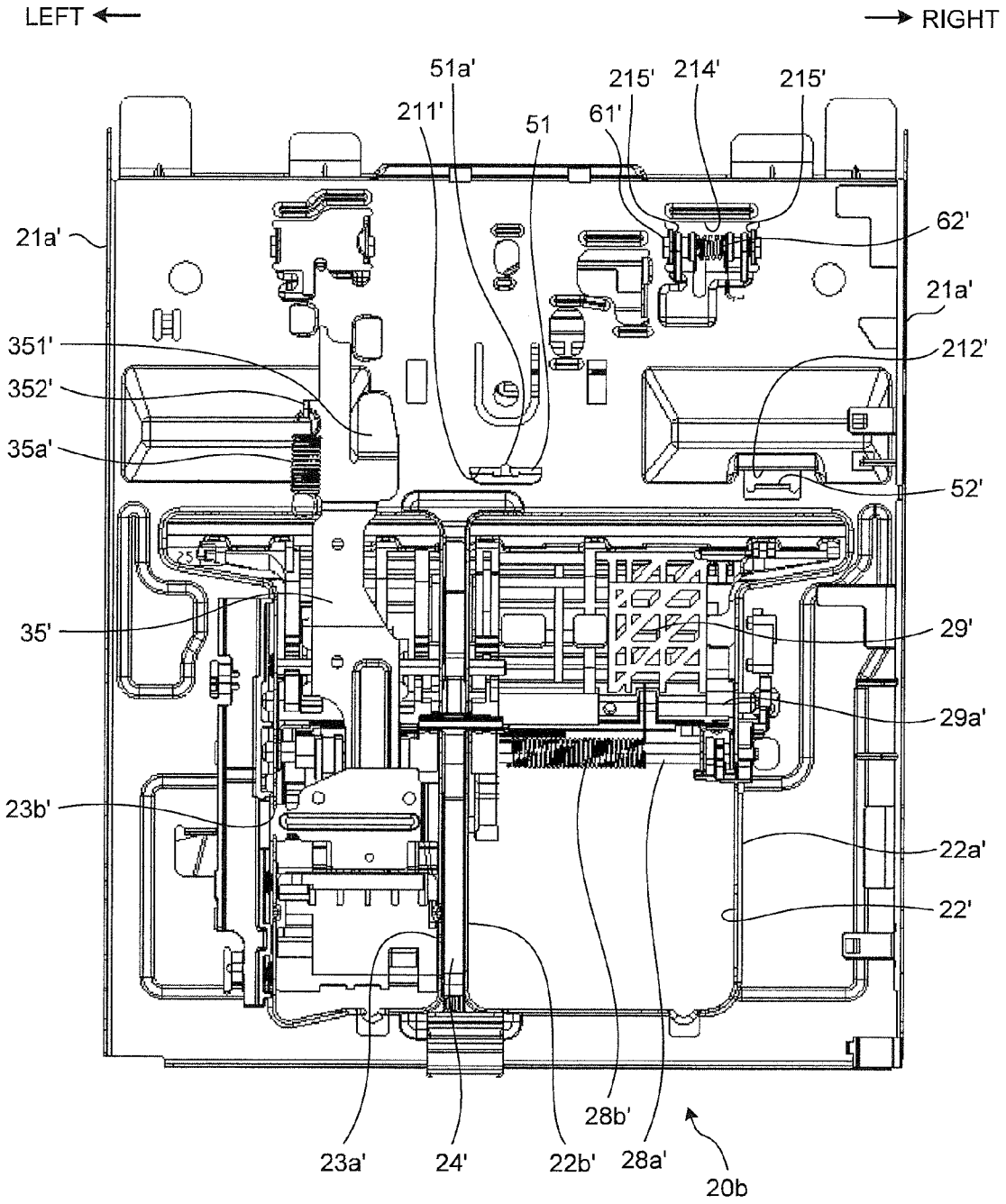
FIG. 16 is a front view of the second product discharging device.
Figure 17:
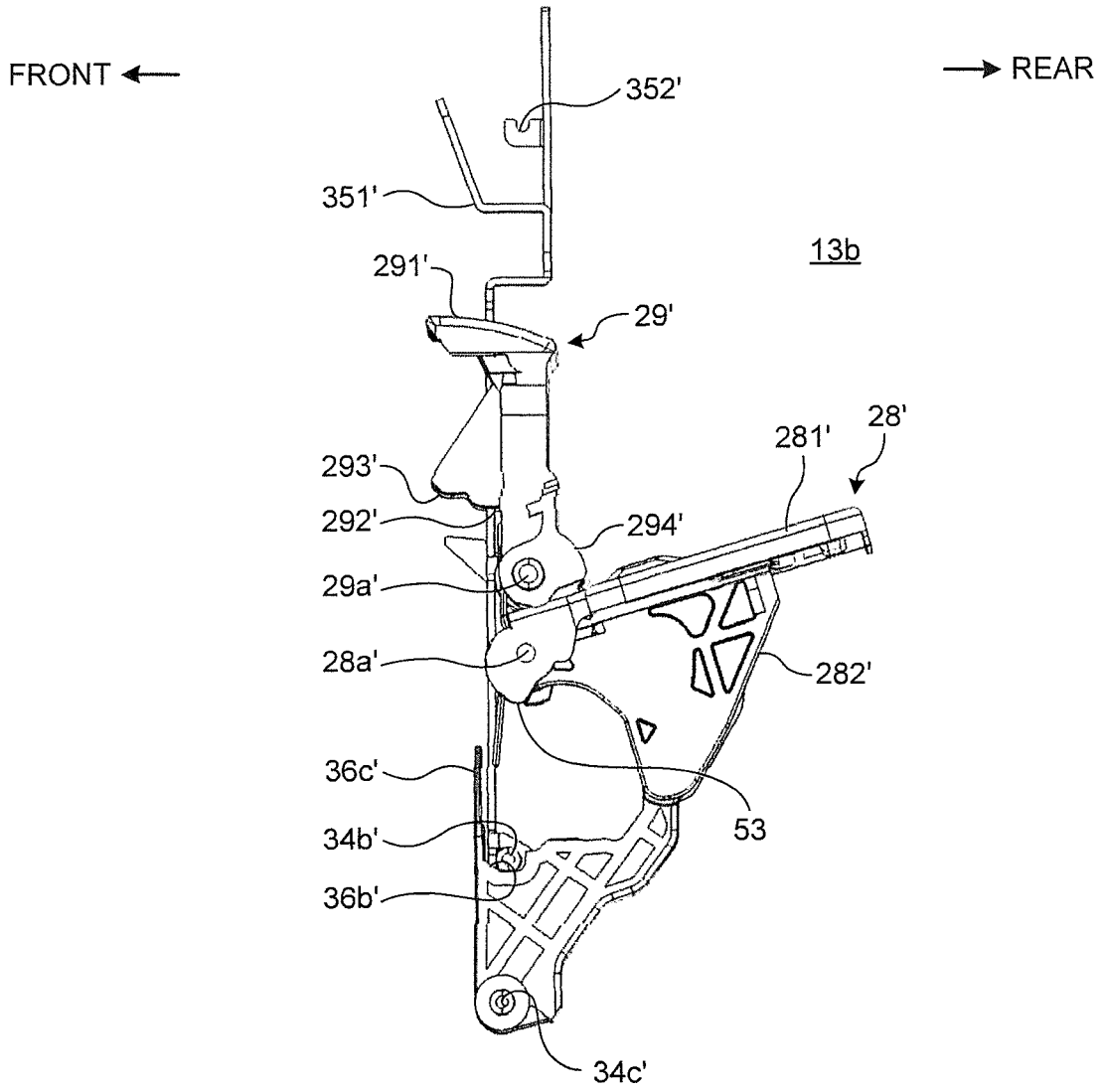
FIG. 17 is a perspective view illustrating the second product discharging device when viewed from the front-right side.

FIG. 16 is a front view illustrating the second product discharging device illustrated in FIGS. 2 and 4 when viewed from the front side and FIG. 17 is a diagram schematically illustrating principal parts of the second product discharging device when viewed from the right side. The most elements of the second product discharging device 20*b* are common to the elements of the first product discharging device 20*a* and are different from the elements of the first product discharging device 20*a*, in that the front-rear direction is different and thus the right-left direction is reversed. Accordingly, in the description of the second product discharging device 20*b*, the elements will be appropriately omitted, and the elements of the second product discharging device 20*b* common to the elements of the first product discharging device 20*a* will be referenced by adding "'" to the reference signs in the first product discharging device 20*a* and will be described in brief.

The second product discharging device 20*b* is applied to the second product storage passage 13*b* and is disposed in the bottom of the second product storage passage 13*b*. The second product discharging device 20*b* serves to store products in the second product storage passage 13*b* in a standby state and to discharge a product to the product chute 5 in an activated state by controlling behavior of product between an opposite passage width defining plate 17 and the second product discharging device, and includes a base 21'.

The base 21' is formed by performing a cutting process and a bending process on a steel sheet and is disposed to cause its own surface to face the passage width defining plate 17. A side wall 21*a*' of the base 21' is formed by bending both sides and a first insertion hole 22' and a second insertion hole 23' are formed in an intermediate portion thereof. The circumferential edges of the first insertion hole 22' and the second insertion hole 23' are bent similarly to the side wall 21*a*' to form a flange.

The first insertion hole 22' and the second insertion hole 23' are arranged in the right-left direction and have the same size in the vertical direction. Among the first insertion hole 22' and the second insertion hole 23', the first insertion hole 22' is located on the right side of the second insertion hole 23', and the width in the right-left direction of the first insertion hole 22' is larger than the width in the right-left direction of the second insertion hole 23'. The first insertion hole 22' and the second insertion hole 23' are through-openings (concave portions for enabling the lower pedal 28' and the upper pedal 29' to be described later to move backward into the base 21') having a substantially rectangular shape as a whole, the top end of the first insertion hole 22' protrudes to the right side, and the top end of the second insertion hole 23' protrudes to the left side. A first right bearing piece 22*a'* is disposed at the right edge portion of the first insertion hole 22', a first left bearing piece 22*b'* is disposed at the left edge portion 471 of the first insertion hole 22', a second right bearing piece 23*a'* is disposed at the right edge portion of the second insertion hole 23', and a second left bearing piece 23*b'* is disposed at the left edge portion 471 of the second insertion hole 23'. The first left bearing piece 22*b'* and the second right bearing piece 23*a'* correspond to the flange formed at the circumferential edges of the first insertion hole 22' and the second insertion hole 23'. The first left bearing piece 22*b'* and the second right bearing piece 23*a'* are formed integrally with the base 21' in a place in which a bearing portion 24' to be described later is fitted and supported and are formed in shaft insertion flanges forming both U-shaped leg pieces in a bearing support portion formed in a U-shaped cross-section (discontinuous). The bearing support portion has a function of maintaining the strength of the base 21' even when a large through-opening including the first insertion hole 22' and the second insertion hole 23' which form a substantially rectangular shape as a whole is formed in the base 21'.

The bearing portion 24' is attached to the base 21' having the above-mentioned configuration. The bearing portion 24' is formed of a resin material or the like and is interposed between the first left bearing piece 22*b'* and the second right bearing piece 23*a'*.

The base 21' is provided with a first swing support shaft 28*a'* and a second swing support shaft 29*a'*. The first swing support shaft 28*a'* is an axial member which is disposed to extend substantially in the horizontal direction and to penetrate through-holes formed in the base 21' and the bearing portion 24', and supports the lower pedal 28' in the middle.

A second sold-out link 70 is disposed at the right end of the first swing support shaft 28*a'*. As illustrated in FIG. 9, the second sold-out link 70 includes a second sold-out base portion 71 and a second sold-out pressing portion 72. The second sold-out base portion 71 is a deformed portion in which a penetration portion penetrated by the right end of the first swing support shaft 28*a'* is formed. The second sold-out pressing portion 72 protrudes to the right side from the top of the second sold-out base portion 71 and extends upward. The penetration portion formed in the second sold-out base portion 71 is formed to be larger than the first swing support shaft 28*a'* and is configured such that the second sold-out link 70 freely moves relative to the first swing support shaft 28*a'*.

In the second sold-out link 70, an inclined guide surface 73 is formed at the upper end of the second sold-out base portion 71. The inclined guide surface 73 is gradually inclined downward to the front side, that is, is gradually inclined downward as it approaches the first product discharging device 20*a*.

The second sold-out link 70 is disposed to interpose the sold-out detection switch 25 between the first sold-out link 30 and the second sold-out link. In other words, the sold-out detection switch 25 is interposed between the first sold-out link 30 and the second sold-out link 70.

The second swing support shaft 29*a'* is an axial member disposed to penetrate the through-holes formed in the base 21' and the bearing portion 24' so as to extend in the substantially horizontal direction in an area above the first swing support shaft 28*a'*, and supports the upper pedal 29' in the middle.

The lower pedal 28' is a plate-like member and is disposed to be swingable about the central axis of the first swing support shaft 28*a'* by inserting the first swing support shaft 28*a'* into the base end thereof.

The tip portion of the lower pedal 28' extends in an outer radial direction of the first swing support shaft 28*a'*, and can move forward to and backward from the second product storage passage 13*b* via the first insertion hole 22' and the second insertion hole 23' when the lower pedal swings about the central axis of the first swing support shaft 28*a'*. That is, the lower pedal 28' is swingably disposed to move forward to and backward from the second product storage passage 13*b*.

A lower pedal spring 28*b'* is interposed between the lower pedal 28 and the base 21'. The lower pedal spring 28*b'* normally biases the lower pedal 28' in the forward moving direction to the second product storage passage 13*b*. More specifically, the lower pedal spring 28*b'* causes the lower pedal 28' to take a standby posture (hereinafter, also referred to as a product-absent standby posture) such that the tip portion of the lower pedal 28' is located higher than the first swing support shaft 28*a'* as illustrated in FIG. 17. When product is placed on the top surface of the lower pedal 28', the lower pedal spring 28*b'* causes the lower pedal 28' to take a standby posture (hereinafter, also referred to as a product-present standby posture) such that the tip portion of the lower pedal 28' is located at the same height level as the first swing support shaft 28*a'*.

Accordingly, in the product-absent standby posture, the tip portion of the lower pedal 28' is located higher than that of the product-present standby posture.

When the lower pedal 28' takes the product-absent standby posture, the base end of the lower pedal 28' comes in contact with a contact portion (not illustrated) disposed in the second sold-out base portion 71 in the second sold-out link 70 as indicated by a two-dot chained line in FIG. 9, thus the second sold-out link 70 rotates about the first swing support shaft 28*a'*, and thus the second sold-out pressing portion 72 presses the second contactor 252 of the sold-out detection switch 25. Accordingly, in the sold-out detection switch 25, the second contactor 252 is pressed and displaced backward against the biasing force of the spring and is switched to the ON state, and thus an ON signal is output to the control unit.

On the other hand, when the lower pedal 28' takes the product-present standby posture, the base end of the lower pedal 28' is separated from the contact portion of the second sold-out link 70 and thus the second sold-out link 70 is switched to a free state as indicated by a solid line in FIG. 9. Accordingly, in the sold-out detection switch 25, the second contactor 252 is biased by the spring to rise upright and is switched to the OFF state, and thus an OFF signal is output to the control unit. That is, the second sold-out link 70 switched to the free state rotates about the first swing support shaft 28*a'* by pressing the second sold-out pressing portion 72 against the second contactor 252.

The lower pedal 28' includes a plate-like pedal body 281' and a pair of guide portions 282'. The pair of guide portions 282' is disposed on the rear side of the pedal body 281'. Each guide portion 282' is a plate-like member extending in the vertical direction and both are formed to face each other. A guide groove (not illustrated) is formed on the facing surfaces of the guide portions 282'.

The guide groove includes a fitting portion which is located at the lowest position in a state in which the lower pedal 28' is disposed at a forward-moved position at which the lower pedal most moves forward to the second product storage passage 13*b* and into which a pedal operating shaft (not illustrated) of a rotation stopper 36' to be described later is fitted, a contact portion which is located at the highest position in a state in which the lower pedal 28' is disposed at a backward-moved position at which the lower pedal most moves backward from the second product storage passage 13*b* and with which the pedal operating shaft of the rotation stopper 36' comes in contact, and a first guide portion and a second guide portion which are continuously connected to the fitting portion and the contact portion.

The first guide portion is formed in the guide portion 282' to be inclined obliquely upward from the fitting portion so as to get away from the base 21', be inclined obliquely upward so as to get close to the base 21', and then reach the contact portion in a state in which the lower pedal 28' is located at the position (forward-moved position) at which the lower pedal most moves forward to the second product storage passage 13*b*.

The second guide portion is formed in the guide portion 282' to be inclined obliquely downward from the contact portion so as to get away from the base 21' and then reach the fitting portion in a state in which the lower pedal 28' is located at the position (forward-moved position) at which the lower pedal most moves forward to the second product storage passage 13*b*.

The length in the outer radial direction of the lower pedal 28' from the first swing support shaft 28*a*' is set to a length with which a gap smaller than the maximum width of a product having a small maximum width can be secured between the passage width defining plate 17 and the lower pedal when the lower pedal is located at the position (forward-moved position) at which the lower pedal most moves forward to the second product storage passage 13*b*.

The upper pedal 29' is a plate-like member and is disposed in the base 21' so as to be swingable about the central axis of the second swing support shaft 29*a*' by inserting the second swing support shaft 29*a*' into the base end thereof.

The tip portion of the upper pedal 29' extends in an outer radial direction of the second swing support shaft 29*a*', and can move forward to and backward from the second product storage passage 13*b* via the first insertion hole 22' and the second insertion hole 23' when the upper pedal swings about the central axis of the second swing support shaft 29*a*'. That is, the upper pedal 29' is swingably disposed to move forward to and backward from the second product storage passage 13*b*.

An upper pedal spring (not illustrated) is interposed between the upper pedal 29' and the base 21'. The upper pedal spring normally biases the upper pedal 29' in the backward moving direction to the second product storage passage 13*b*.

The upper pedal 29' is provided with a pressing inclined surface 291', a concave portion 292', a stopper contact portion 293', and a protrusion 294'. The pressing inclined surface 291' is disposed in the tip portion of the upper pedal 29' and is a curved inclined surface which is formed to be gradually lowered toward the second product storage passage 13*b* when the upper pedal 29' moves backward from the second product storage passage 13*b*. The concave portion 292' is disposed on the rear side of the upper pedal 29' and is a set of concave places extending substantially in the horizontal direction and being formed to be opened to both side surfaces of the upper pedal 29'. The stopper contact portion 293' is a portion with which a stopper pin to be described later comes in contact and is disposed to be inclined to the upper side of the concave portion 292' on the rear surface of the upper pedal 29'.

The protrusion 294' is disposed at the base end of the upper pedal 29' so as to protrude toward the second product storage passage 13*b*.

The upper pedal 29' is biased to move backward from the second product storage passage 13*b* by a biasing force of the upper pedal spring, but the initial position thereof is set in a state in which the upper pedal moves backward from the second product storage passage 13*b* by bringing the stopper pin into contact with the concave portion 292'.

The upper pedal 29' is inclined to the front side with respect to the vertical plane passing through the second swing support shaft 29*a*' in a state in which the upper pedal is located at the position (forward-moved position) at which the upper pedal most moves forward to the second product storage passage 13*b*. The length in the outer radial direction of the upper pedal 29' from the second swing support shaft 29*a*' is set to a length with which a gap smaller than the maximum width of a product having a small maximum width can be secured between the passage width defining plate 17 and the upper pedal in the state in which the upper pedal is inclined to the front side.

In the base 21', the stopper pin (not illustrated), the pedal stopper pin 34*b*', and the stopper shaft 34*c*' are disposed between the bearing portion 24' and the second left bearing piece 23*b*'.

The stopper pin is an axial member which is disposed substantially in the horizontal direction between the bearing portion 24' and the second left bearing piece 23*b*'. The stopper pin is coupled to the pedal link 35' and is movable in the vertical direction with the movement in the vertical direction of the pedal link 35'. The stopper pin comes in contact with the concave portion 292' of the upper pedal 29' located at the initial position.

The pedal stopper pin 34*b*' is an axial member which is disposed substantially in the horizontal direction between the bearing portion 24' and the second left bearing piece 23*b*'. The pedal stopper pin 34*b*' is coupled to the pedal link 35' and is movable in the vertical direction with the movement in the vertical direction of the pedal link 35'.

The stopper shaft 34*c*' is an axial member which is disposed substantially in the horizontal direction between the bearing portion 24' and the second left bearing piece 23*b*' and supports the rotation stopper 36' in the middle thereof.

The rotation stopper 36' is disposed between the bearing portion 24' and the second left bearing piece 23*b*' so as to insert the stopper shaft 34*c*' into the insertion hole of the base end thereof and to be swingable about the central axis of the stopper shaft 34*c*'.

The tip portion of the rotation stopper 36' extends in the outer radial direction of the stopper shaft 34*c*' and is movable forward to and backward from the second product storage passage 13*b* via the second insertion hole 23' when the rotation stopper swings about the central axis of the stopper shaft 34*c*'.

The rotation stopper 36' includes a pedal operating shaft so as to insert the pedal operating shaft (not illustrated) into the through-hole (not illustrated) of the tip portion thereof. The pedal operating shaft is an axial member which is disposed substantially in the horizontal direction and both ends thereof are fitted into the guide grooves of the lower pedal 28'.

A pedal operating spring (not illustrated) is interposed between the rotation stopper 36' and the base 21'. The pedal operating spring normally biases the rotation stopper 36' in the forward moving direction to the second product storage passage 13*b*.

The rotation stopper 36' is biased in the forward moving direction to the second product storage passage 13*b* by the pedal operating spring, movement in the backward moving direction thereof is regulated by moving the pedal stopper pin 34*b*' into a recessed portion 36*b*' of the rotation stopper 36' to come in contact with the pedal stopper pin 34*b*', and the initial position thereof in the state in which the rotation stopper moves forward to the second product storage passage 13*b* is set. Since the lower pedal 28' is biased by the lower pedal spring 28*b*', the initial position of the rotation stopper 36' is set to a position at which both ends of the pedal operating shaft are located in the fitting portion of the guide grooves and the lower pedal 28' moves forward to the second product storage passage 13*b*.

The rotation stopper 36' is provided with a panel-like blindfold portion 36*c*' extending upward on the rear side thereof, that is, on the rear side of the recessed portion 36*b*'. The blindfold portion 36*c*' covers a part of the pedal stopper pin 34*b*' opposite to the second product storage passage 13*b*. More specifically, the blindfold portion 36*c*' covers the part, which is opposite to the second product storage passage 13*b*, of the pedal stopper pin 34*b*' moving in the vertical direction.

The pedal link 35' is a long plate-like member extending in the vertical direction and an upper portion thereof is bent to the rear side and then extends upward. The upper portion of the pedal link 35' is provided with a contact piece 351' extending forward and then extending obliquely upward and a locking portion 352' locking a link spring 35*a*'. The link spring 35*a*' is interposed between the pedal link 35' and the base 21' and normally biases the pedal link 35' downward.

In a state in which the pedal link 35' is biased by the link spring 35*a*' and is located at a reference position on the lower side, the concave portion 292' of the upper pedal 29' disposed at the backward-moved position comes in contact with the stopper pin. The rotation stopper 36' disposed at the forward-moved position comes in contact with the pedal stopper pin 34*b*' to regulate the backward movement of the rotation stopper 36'. The pedal operating shaft of the rotation stopper 36' disposed at the forward-moved position is fitted into the fitting portion of the lower pedal 28' to regulate the backward movement of the lower pedal 28' disposed at the forward-moved position.

On the other hand, in the state in which the pedal link 35' is located on the upper side against the biasing force of the link spring 35*a*', the stopper contact portion 293' of the upper pedal 29' comes in contact with the stopper pin to regulate the backward movement of the upper pedal 29', and the upper pedal 29' moves forward against the biasing force of the upper pedal spring and is disposed at the forward-moved position.

On the other hand, since the regulation of the backward movement due to the pedal stopper pin 34*b*' is released, the regulation of the backward movement of the rotation stopper 36' with respect to the stopper shaft 34*c*' is released. Here, the weight of a product coming in contact with the lower pedal 28' maintained at the forward-moved position by the rotation stopper 36' is applied to the rotation stopper 36', and the rotation stopper 36' starts its backward movement with releasing the regulation of the backward movement of the rotation stopper 36'. When the backward movement of the rotation stopper 36 is started, the pedal operating shaft departs from the fitting portion of the lower pedal 28'. Accordingly, the lower pedal 28' is allowed to move backward about the first swing support shaft 28*a*' and moves backward against the elastic biasing force of the lower pedal spring 28*b*' by the weight of the product.

When the lower pedal 28' moves backward in this way, the base end of the lower pedal 28' is separated from a second sold-out contact portion of the second sold-out link 70 and thus the second sold-out link 70 is switched to the free state. Accordingly, in the sold-out detection switch 25, the second contactor 252 is biased by the spring to rise upright and thus to maintain the OFF state. That is, when the lower pedal 28' moves backward, similarly to the product-present standby posture, the second sold-out link 70 does not press the second contactor 252 of the sold-out detection switch 25.

The second product discharging device 20*b* having such a configuration includes a cover flapper 50' and a lever member 60' in addition to the above-mentioned configuration.

The cover flapper 50' is a long member which has a width in the right-left direction slightly smaller than that of the base 21' and of which the right-left direction is the length direction thereof as illustrated in FIGS. 4 and 16. In the cover flapper 50', a first tongue-like portion 51' is formed at an upper end of the central portion thereof and a second tongue-like portion 52' is formed on the right side of the first tongue-like portion 51'. A cut-raised portion 51*a*' is formed in the first tongue-like portion 51'.

In the cover flapper 50', the cut-raised portion 51*a*' comes in contact with the front surface of the base 21' by inserting the first tongue-like portion 51' into a first axial support hole 211' formed at the center of the base 21' from the front side and the cover flapper is disposed to be swingable so as to move forward to and backward from the first product storage passage 13*a* by inserting the second tongue-like portion 52' into a second axial support hole 212' formed on the right side of the base 21' from the front side. The cover flapper 50' is pressed by the upper pedal 29' to move forward when the upper pedal 29' moves forward to the first product storage passage 13*a* and moves backward along with the upper pedal 29' when the upper pedal 29' moves backward from the first product storage passage 13*a*. Here, the second tongue-like portion 52' is inserted into the second axial support hole 212' to regulate the rotational movement of the cover flapper 50' about the first tongue-like portion 51' in the clockwise or counterclockwise direction in a rear view.

In an area above the position at which the cover flapper 50' is disposed, that is, in an area above the upper pedal 29', in the base 21' constituting the second product discharging device 20*b*, protrusions 213' protruding to the second product storage passage 13*b* are formed on an upper edge portion and a lower edge portion in the vicinity of plural openings to be formed.

The lever member 60' is swingably disposed to be movable forward to and backward from the second product storage passage 13*b* in a state in which the lever member penetrates a lever opening 214' of the right top end of the base 21'. More specifically, a pair of right and left lever locking pieces 215' protruding to the rear side is formed on both edges of the lever opening 214' on the rear side of the base 21', and the lever member 60' is disposed to be swingable about the axes of shaft portions 61' formed in the lever locking pieces 215' as illustrated in FIGS. 4 and 16. A lever spring 62' is interposed between the lever member 60' and the base 21' so as to be wound on the shaft portion 61', and the lever member 60' is biased by the lever spring 62' and takes a posture in which the tip portion moves forward to the first product storage passage 13*a* in a normal state.

The wiring cover 80 is disposed to cover the lower ends of the first product discharging device 20*a* and the second product discharging device 20*b*. The wiring cover 80 is formed of an elastic resin material such as polypropylene and serves to guide wirings of the units such as the sold-out detection switch 25 and the drive unit 40 which are attached to the first product discharging device 20*a*.

Figure 18:
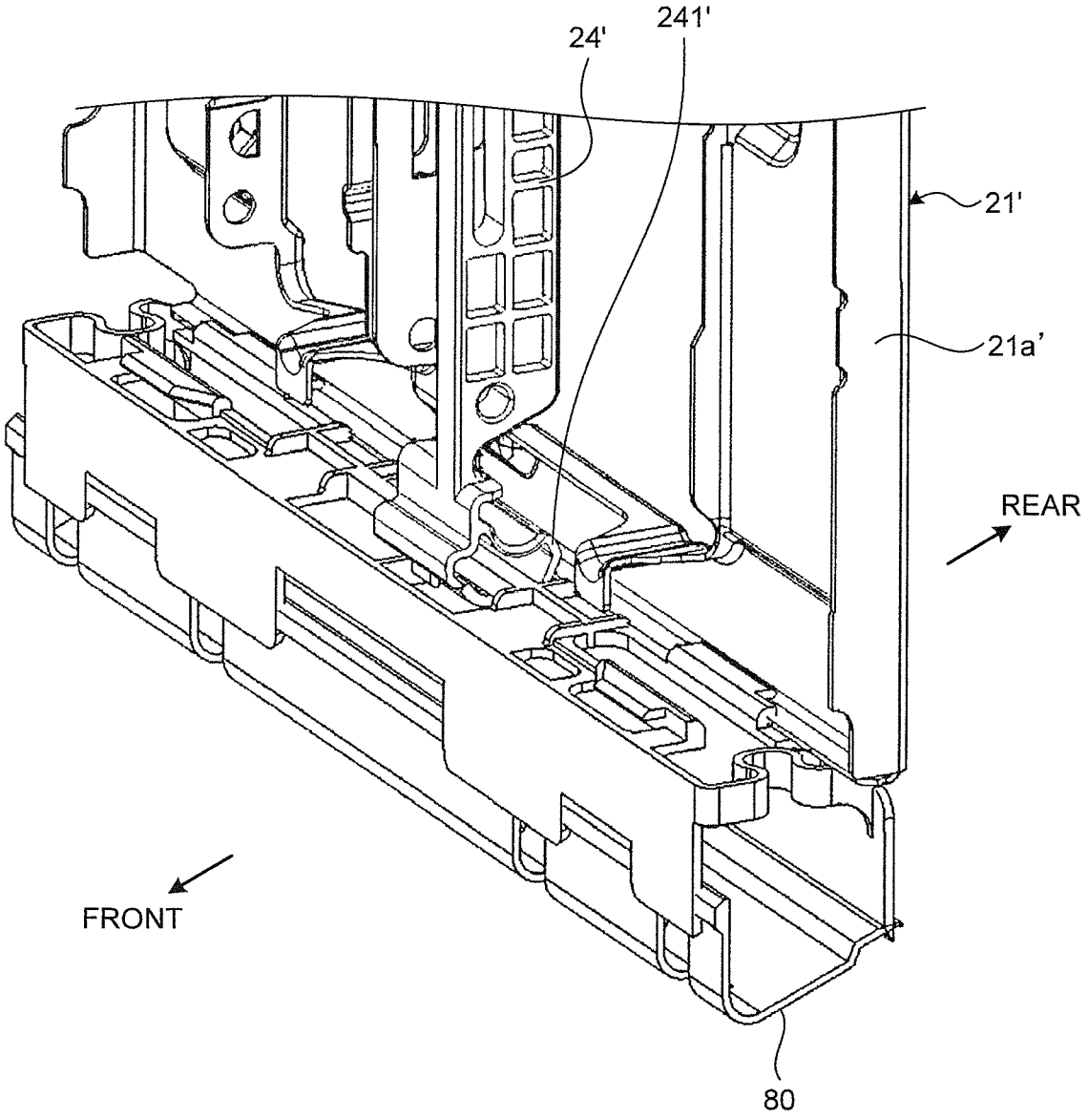
FIG. 18 is a perspective view illustrating a mounted state of a wiring cover.
Figure 19:
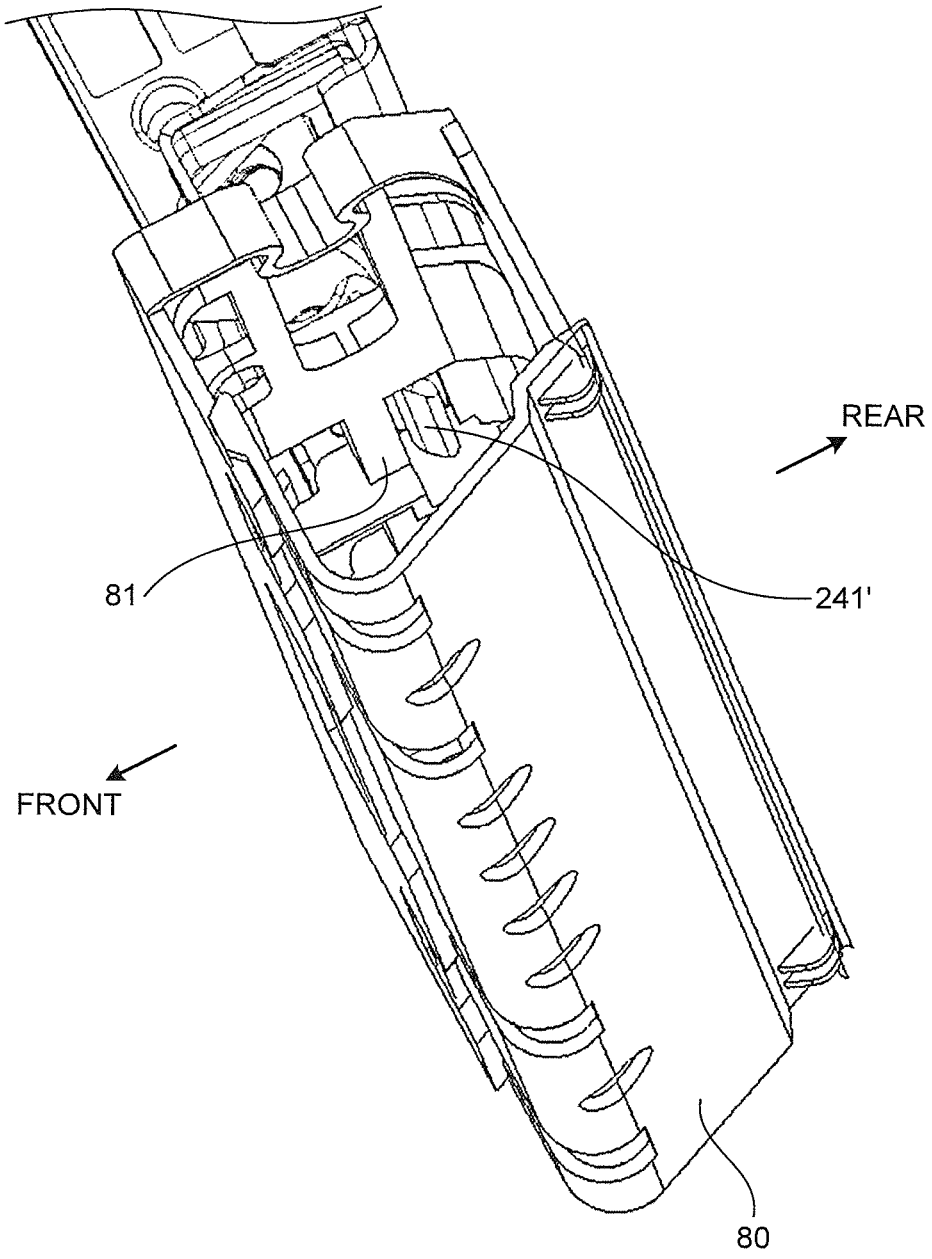
FIG. 19 is a perspective view illustrating the mounted state of the wiring cover.

The wiring cover 80 receives and locks a lower end 241' of the bearing portion 24' fitted to the second product discharging device 20*b* as illustrated in FIG. 18, and includes a regulation portion 81 on the front side of the lower end 241' as illustrated in FIG. 19. The regulation portion 81 regulates displacement of the lower end 241' of the bearing portion 24' going into the wiring cover 80 to the front side, that is, displacement in the direction getting close to the first product discharging device 20*a*.

The product dispensing system 20 having the above-mentioned configuration operates as follows in the standby state.

In the drive unit 40 of the first product discharging device 20*a*, the cam portion 443*a* and the pressing piece 443*b* of the output gear 443 are located at the highest position and the pressing piece 443*b* presses the contactor 45*a* of the carrier switch 45. In this case, the carrier switch 45 is in the ON state. In this standby state, the tip portion 461*b* of the first link lever 461 constituting the drive unit 40 is located at a position separated downward from the contact piece 351 of the pedal link 35 and the tip portion 462*b* of the second link lever 462 is located at a position separated downward from the contact piece 351' of the pedal link 35'.

Accordingly, in the first product discharging device 20*a*, as illustrated in FIG. 5, the pedal link 35 is disposed on the lower side. When a product is placed on the top surface of the lower pedal 28 due to the products input to the first product storage passage 13*a*, the lower pedal 28 takes the product-present standby posture and the upper pedal 29 takes the posture in which the upper pedal moves backward from the first product storage passage 13*a*. In this way, since the lower pedal 28 takes the product-present standby posture, the sold-out detection switch 25 (first sold-out detection unit 25*a*) takes the posture in which the first contactor 251 rises upright and is in the OFF state.

In the second product discharging device 20*b*, the pedal link 35' is disposed on the lower side, the lower pedal 28' takes the product-present standby posture, and the upper pedal 29' takes the posture in which the upper pedal moves backward from the second product storage passage 13*b*. In this way, since the lower pedal 28' takes the product-present standby posture, the sold-out detection switch 25 (second sold-out detection unit 25*b*) takes the posture in which the second contactor 252 rises upright and is in the OFF state.

When a command to discharge a product (hereinafter, also referred to as "first product") stored in the first product storage passage 13*a* is issued from the control unit, the product dispensing system 20 operates as follows.

When the motor 43 is positively driven, the output gear 443 to which the driving force of the motor 43 is transmitted via the worm gear 441 and the intermediate gear 442 rotates clockwise in a front view.

When the output gear 443 rotates clockwise in a front view, the pressing piece 443*b* of the output gear 443 departs from the contactor 45*a* of the carrier switch 45. Accordingly, the contactor 45*a* of the carrier switch 45 is released from the pressed state and is switched to the OFF state.

Figure 20:
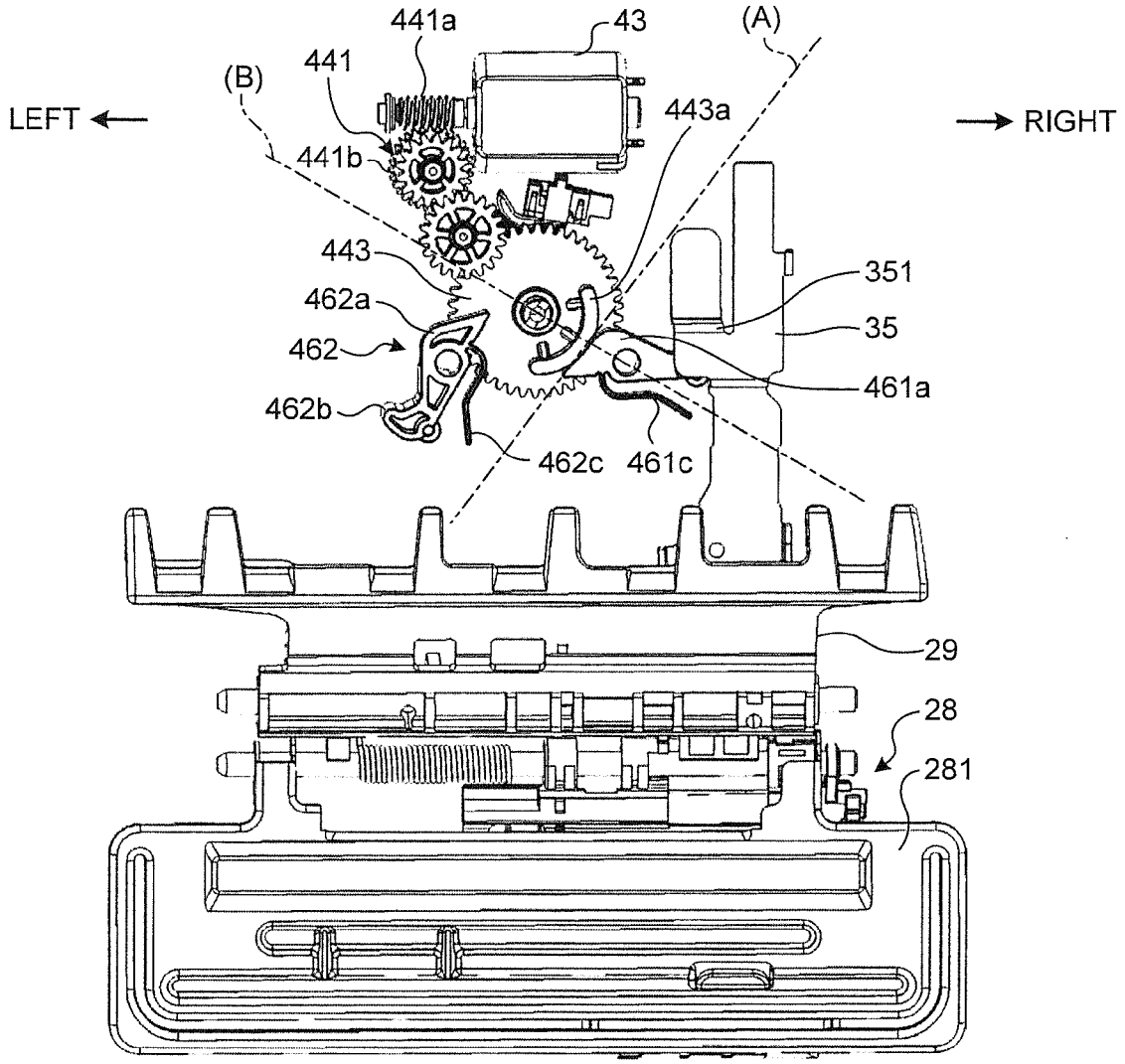
FIG. 20 is a diagram illustrating operations of the principal parts of the drive unit when viewed from the front side.
Figure 21:
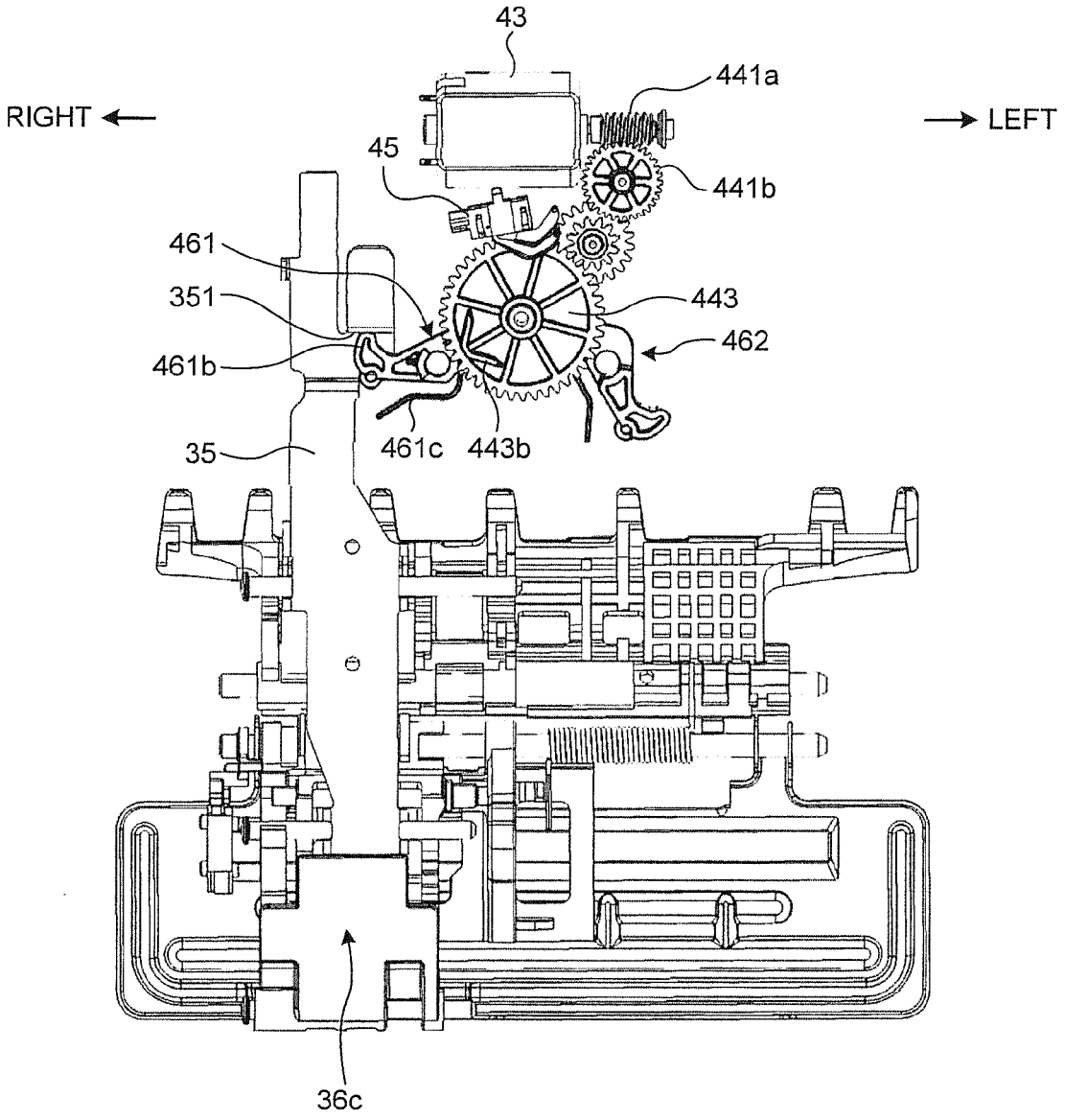
FIG. 21 is a diagram illustrating the operations of the principal parts of the drive unit when viewed from the rear side.

When the cam portion 443*a* comes in contact with the base end 461*a* of the first link lever 461 from the upper side with the rotation of the output gear 443, the first link lever 461 rotates counterclockwise in the front view as illustrated in FIGS. 20 and 21. When the first link lever 461 rotates counterclockwise, the tip portion 461*b* moves upward. When the tip portion 461*b* moves upward in this way, the tip portion comes in contact with the contact piece 351 of the pedal link 35, the pedal link 35 can move upward by a predetermined distance against the biasing force of the link spring 35*a*, and the pedal link 35 can be held in the state in which the pedal link moves upward by the predetermined distance while the cam portion 443*a* comes in sliding contact with the base end 461*a*.

In this case, when the first link lever 461 comes in sliding contact with the cam portion 443*a*, the first link lever is adjusted such that the plane (A) including the portion coming in sliding contact with the cam portion 443*a* is substantially perpendicular to the plane (B) including its central axis (the central axis of the first link shaft 42*e*) and a central axis of the output gear 443.

With the upward movement of the pedal link 35, the stopper pin 34*a* moves upward and the pedal stopper pin 34*b* moves upward.

At this time, since the stopper pin 34*a* moves upward while coming in contact with the edge wall of the concave portion 292 of the upper pedal 29, the upper pedal 29 moves forward from the initial position against the biasing force of the upper pedal spring. The forward movement of the upper pedal 29 is performed along with the upward movement of the stopper pin 34*a*. At the time at which the stopper pin 34*a* reaches a predetermined top end, the stopper pin comes in contact with the stopper contact portion 293 to regulate the backward movement of the upper pedal 29.

The upper pedal 29 moving forward comes in contact with a second lowest piece of first product (hereinafter, also referred to as a next product) to regulate downward movement of the next product.

On the other hand, since the weight of the product coming in contact with the lower pedal 28 maintained at the forward-moved position is applied to the rotation stopper 36, the rotation stopper 36 starts its backward movement by releasing the regulation of the backward movement due to the upward movement of the pedal stopper pin 34*b*.

When the rotation stopper 36 starts the backward movement in this way, the pedal operating shaft 361 departs from the fitting portion 283*a* and the lower pedal 28 starts its backward movement against the biasing force of the lower pedal spring 28*b* with the weight of the product. The pedal operating shaft 361 of the rotation stopper 36 departing from the fitting portion 283*a* moves to a position at which the first guide portion 283*b* and the second guide portion 283*c* intersect each other along the first guide portion 283*b*.

Thereafter, the lower pedal 28 moves backward with the weight of the lowest product, the downward movement of the lowest product is allowed, and the lowest product is discharged downward (see FIG. 8). The discharged product is guided to the product discharge port 3*c* via the product chute 5 and can be taken out via the product output port 2*a*.

When the lowest product passes through the lower pedal 28, the lower pedal 28 moves to the forward-moved position with the elastic biasing force of the lower pedal spring 28*b* and the rotation stopper 36 also moves to the forward-moved position with the elastic biasing force of the pedal operation spring. When the lower pedal 28 and the rotation stopper 36 move to the forward-moved position, the pedal operating shaft 361 held at the position at which the first guide portion 283*b* and the second guide portion 283*c* intersect each other moves to the fitting portion 283*a* along the second guide portion 283*c*, and the lower pedal 28 and the rotation stopper 36 are returned to the forward-moved position.

In the meantime, the pedal link 35 moves upward, the stopper pin 34*a* is located at a predetermined top end, and the pedal stopper pin 34*b* is located at a predetermined top end.

Thereafter, when the contact of the cam portion 443*a* with the base end 461*a* is released with the rotation of the output gear 443, the pedal link 35 is biased to move downward by the link spring 35*a*.

With the downward movement of the pedal link 35, the stopper pin 34*a* moves downward and the pedal stopper pin 34*b* moves downward.

When the pedal stopper pin 34*b* moves downward, the pedal stopper pin 34*b* comes in contact with the recessed portion 36*b* on the rear side of the rotation stopper 36 returned to the forward-moved position. Accordingly, the movement in the backward moving direction is regulated and the lower pedal 28 is returned to the product-absent standby posture in which the lower pedal moves forward to the first product storage passage 13*a* by the biasing force of the lower pedal spring 28*b*.

On the other hand, the upper pedal 29 is biased by the upper pedal spring and moves backward with the downward movement of the stopper pin 34*a*. Accordingly, the downward movement of the next product is allowed, then the next product comes in contact with the forward-moved lower pedal 28 to regulate the downward movement thereof, and the lower pedal 28 transitions to the product-present standby posture and is returned to the standby state.

In the drive unit 40, the cam portion 443*a* comes in contact with the base end 462*a* of the second link lever 462 with the clockwise rotation of the output gear 443 in a front view. In this case, since the locking portion 462*c* comes in contact with the right edge portion 472 of the left opening, the rotation of the second link lever 462 about the central axis is regulated. Accordingly, the locking portion 462*c* is elastically deformed to bring the base end 462*a* close to the locking portion 462*c*, thereby not interfering with the movement of the cam portion 443*a* due to the rotation of the output gear 443.

Thereafter, when the cam portion 443*a* is returned to the position of the standby state with the rotation of the output gear 443, the pressing piece 443*b* presses the contactor 45*a* of the carrier switch 45 to switch the carrier switch 45 to the ON state. Immediately after the pressing piece 443*b* presses the contactor 45*a* of the carrier switch 45, the cam portion 443*a* departs from the base end 462*a* of the second link lever 462 and the second link lever 462 is returned to the original state by the locking portion 462*c*.

On the other hand, when a command to discharge a product (hereinafter, also referred to as "second product") stored in the second product storage passage 13*b* is issued from the control unit, the product dispensing system 20 operates as follows.

When the motor 43 is reversely driven, the output gear 443 to which the driving force of the motor 43 is transmitted via the worm gear 441 and the intermediate gear 442 rotates counterclockwise in a front view.

When the output gear 443 rotates counterclockwise in a front view, the pressing piece 443*b* of the output gear 443 departs from the contactor 45*a* of the carrier switch 45. Accordingly, the contactor 45*a* of the carrier switch 45 is released from the pressed state and is switched to the OFF state.

When the cam portion 443*a* comes in contact with the base end 462*a* of the second link lever 462 from the upper side with the rotation of the output gear 443, the second link lever 462 rotates clockwise in the front view. When the second link lever 462 rotates clockwise, the tip portion 462*b* moves upward. When the tip portion 462*b* moves upward in this way, the tip portion comes in contact with the contact piece 351' of the pedal link 35', the pedal link 35' can move upward by a predetermined distance against the biasing force of the link spring 35*a'*, and the pedal link 35' can be held in the state in which the pedal link moves upward by the predetermined distance while the cam portion 443*a* comes in sliding contact with the base end 462*a*.

In this case, when the second link lever 462 comes in sliding contact with the cam portion 443*a*, not clearly illustrated in the drawing, the second link lever is adjusted such that the plane including the portion coming in sliding contact with the cam portion 443*a* is substantially perpendicular to the plane including its central axis (the central axis of the second link shaft 42*f*) and the central axis of the output gear 443.

With the upward movement of the pedal link 35', the stopper pin moves upward and the pedal stopper pin 34*b'* also moves upward.

At this time, since the stopper pin moves upward while coming in contact with the edge wall of the concave portion 292' of the upper pedal 29', the upper pedal 29' moves forward from the initial position against the biasing force of the upper pedal spring. The forward movement of the upper pedal 29' is performed along with the upward movement of the stopper pin. At the time at which the stopper pin reaches a predetermined top end, the stopper pin comes in contact with the stopper contact portion 293' to regulate the backward movement of the upper pedal 29'.

The upper pedal 29' moving forward comes in contact with a second lowest piece of second product (hereinafter, also referred to as a next product) to regulate downward movement of the next product.

On the other hand, since the weight of the product coming in contact with the lower pedal 28' maintained at the forward-moved position is applied to the rotation stopper 36', the rotation stopper 36' starts its backward movement by releasing the regulation of the backward movement due to the upward movement of the pedal stopper pin 34*b'*.

When the rotation stopper 36' starts the backward movement in this way, the pedal operating shaft 361' departs from the fitting portion and the lower pedal 28' starts its backward movement against the biasing force of the lower pedal spring 28*b'* with the weight of the product. The pedal operating shaft 361' of the rotation stopper 36' departing from the fitting portion moves to a position at which the first guide portion and the second guide portion intersect each other along the first guide portion.

Thereafter, the lower pedal 28' moves backward with the weight of the lowest product, the downward movement of the lowest product is allowed, and the lowest product is discharged downward. The discharged product is guided to the product discharge port 3*c* via the product chute 5 and can be taken out via the product output port 2*a*.

When the lowest product passes through the lower pedal 28', the lower pedal 28' moves to the forward-moved position with the elastic biasing force of the lower pedal spring 28*b'* and the rotation stopper 36' also moves to the forward-moved position with the elastic biasing force of the pedal operation spring. When the lower pedal 28' and the rotation stopper 36' move to the forward-moved position, the pedal operating shaft 361' held at the position at which the first guide portion and the second guide portion intersect each other moves to the fitting portion along the second guide portion, and the lower pedal 28' and the rotation stopper 36' are returned to the forward-moved position.

Thereafter, when the contact of the cam portion 443*a* with the base end 462*a* is released with the rotation of the output gear 443, the pedal link 35' is biased to move downward by the link spring 35*a'*.

With the downward movement of the pedal link 35', the stopper pin moves downward and the pedal stopper pin 34*b'* also moves downward.

When the pedal stopper pin 34*b'* moves downward to a predetermined lower end, the pedal stopper pin 34*b'* comes in contact with the recessed portion 36*b'* on the rear side of the rotation stopper 36' returned to the forward-moved position. Accordingly, the movement in the backward moving direction is regulated and the lower pedal 28' is returned to the product-absent standby posture in which the lower pedal moves forward to the second product storage passage 13*b* by the biasing force of the lower pedal spring 28*b'*.

On the other hand, the upper pedal 29' is biased by the upper pedal spring and moves backward with the downward movement of the stopper pin. Accordingly, the downward movement of the next product is allowed, then the next product comes in contact with the forward-moved lower pedal 28' to regulate the downward movement thereof, and the lower pedal 28' transitions to the product-present standby posture and is returned to the standby state.

In the drive unit 40, the cam portion 443*a* comes in contact with the base end 461*a* of the first link lever 461 with the counterclockwise rotation of the output gear 443 in a front view. In this case, since the locking portion 461*c* comes in contact with the left edge portion 471 of the right opening, the rotation of the first link lever 461 about the central axis is regulated. Accordingly, the locking portion 461*c* is elastically deformed to bring the base end 461*a* close to the locking portion 461*c*, thereby not interfering with the movement of the cam portion 443*a* due to the rotation of the output gear 443.

Then, when the cam portion 443*a* is returned to the position of the standby state with the rotation of the output gear 443, the pressing piece 443*b* presses the contactor 45*a* of the carrier switch 45 to switch the carrier switch 45 to the ON state.

For example, when the product in the second product storage passage 13*b* is sold out, the base end of the lower pedal 28' comes in contact with the contact portion of the second sold-out link 70 and thus the second sold-out link 70 rotates about the first swing support shaft 28*a'* to cause the second sold-out pressing portion 72 to press the second contactor 252 of the sold-out detection switch 25. Accordingly, in the sold-out detection switch 25, the second contactor 252 is pressed and displaced forward against the biasing force of the spring into the ON state, and outputs the ON signal to the control unit. Accordingly, it is determined that the second product is sold out and thus a sold-out lamp and the like can be lighted.

The product dispensing system 20 and the product discharging devices 20*a* and 20*b* which have been described above exhibit the following operational advantages.

According to the above-mentioned product dispensing system 20, since the first product discharging device 20*a* includes the motor 43 serving as a drive source for the first product discharging device 20*a* and the second product discharging device 20*b* and the drive unit 40 that alternatively selects the first product discharging device 20*a* and the second product discharging device 20*b* in accordance with a discharge command and applies the driving force from the motor 43 to the selected discharging device when the discharge command is issued, it is possible to decrease the number of drive sources in comparison with the number of discharge mechanisms and to decrease the manufacturing cost. Since the first product discharging device 20*a* includes the drive unit 40 including the motor 43, it is also possible to use only the first product discharging device 20*a*. That is, the present disclosure can be applied to a product storage rack 10 in which an odd number of product storage passages 13 are arranged in the front-rear direction as well as the product storage rack 10 in which an even number of product storage passages 13 are arranged in the front-rear direction. Accordingly, it is possible to achieve a decrease in manufacturing cost and to flexibly work depending on the number of product storage passages 13 adjacent in the front-rear direction.

According to the product dispensing system 20, the sold-out detection switch 25 is interposed between the first sold-out link 30 and the second sold-out link 70. Accordingly, when the second product discharging device 20*b* is detached from the first product discharging device 20*a*, the second sold-out link 70 is not likely to interfere with the second contactor of the sold-out detection switch and it is thus possible to easily detach the second product discharging device 20*b*.

Figure 22:
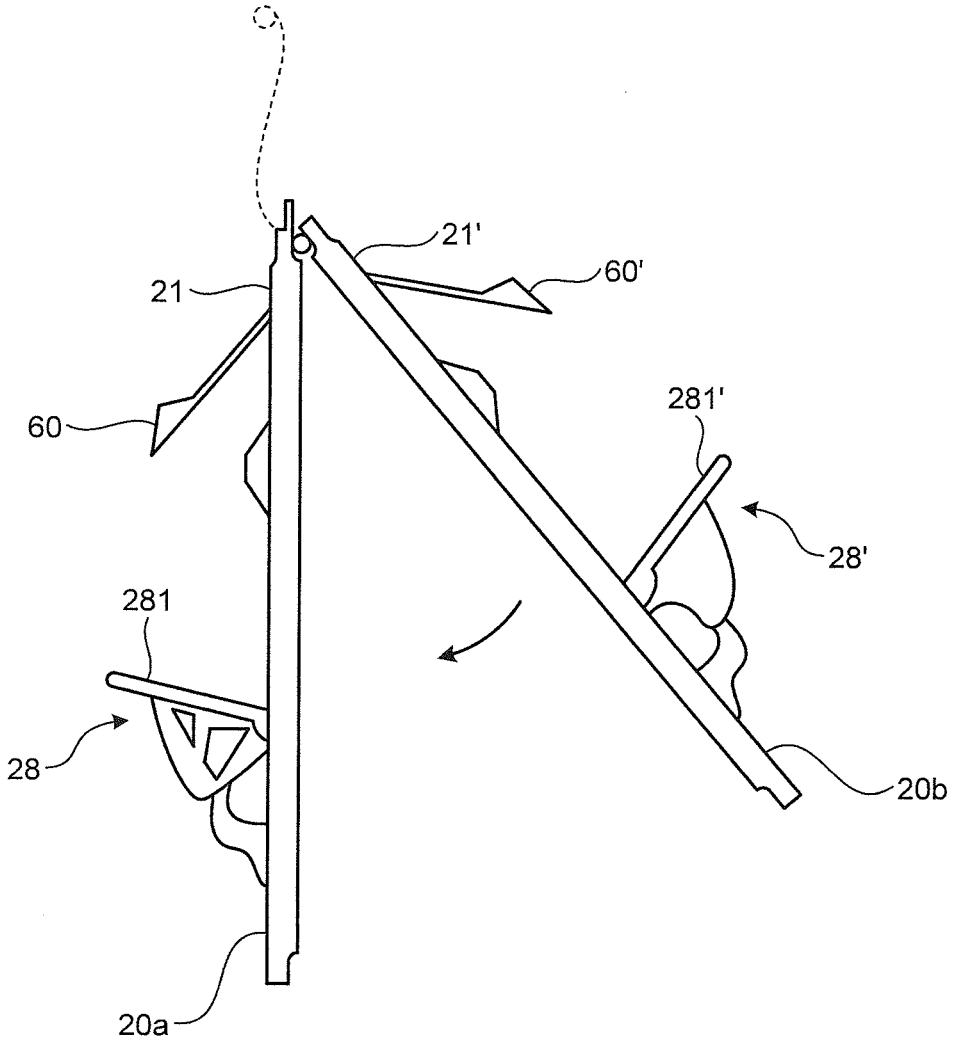
FIG. 22 is a diagram illustrating a state in which the second product discharging device is attached to the first product discharging device.
Figure 23:
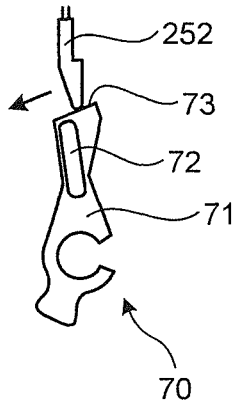
FIG. 23 is a diagram illustrating an operation of an inclined guide surface of a second sold-out link.

According to the product dispensing system 20, the inclined guide surface 73 which is gradually inclined downward as it approaches the first product discharging device 20*a* is formed at the upper end of the second sold-out link 70. Accordingly, when the second product discharging device 20*b* is attached to the first product discharging device 20*a* as illustrated in FIG. 22 and the second contactor 252 of the sold-out detection switch 25 comes in contact with the upper end of the second sold-out link 70 as illustrated in FIG. 23, the second contactor 252 can be guided to the front side along the inclined guide surface 73. Accordingly, it is possible to easily attach the second product discharging device 20*b*.

Figure 10:
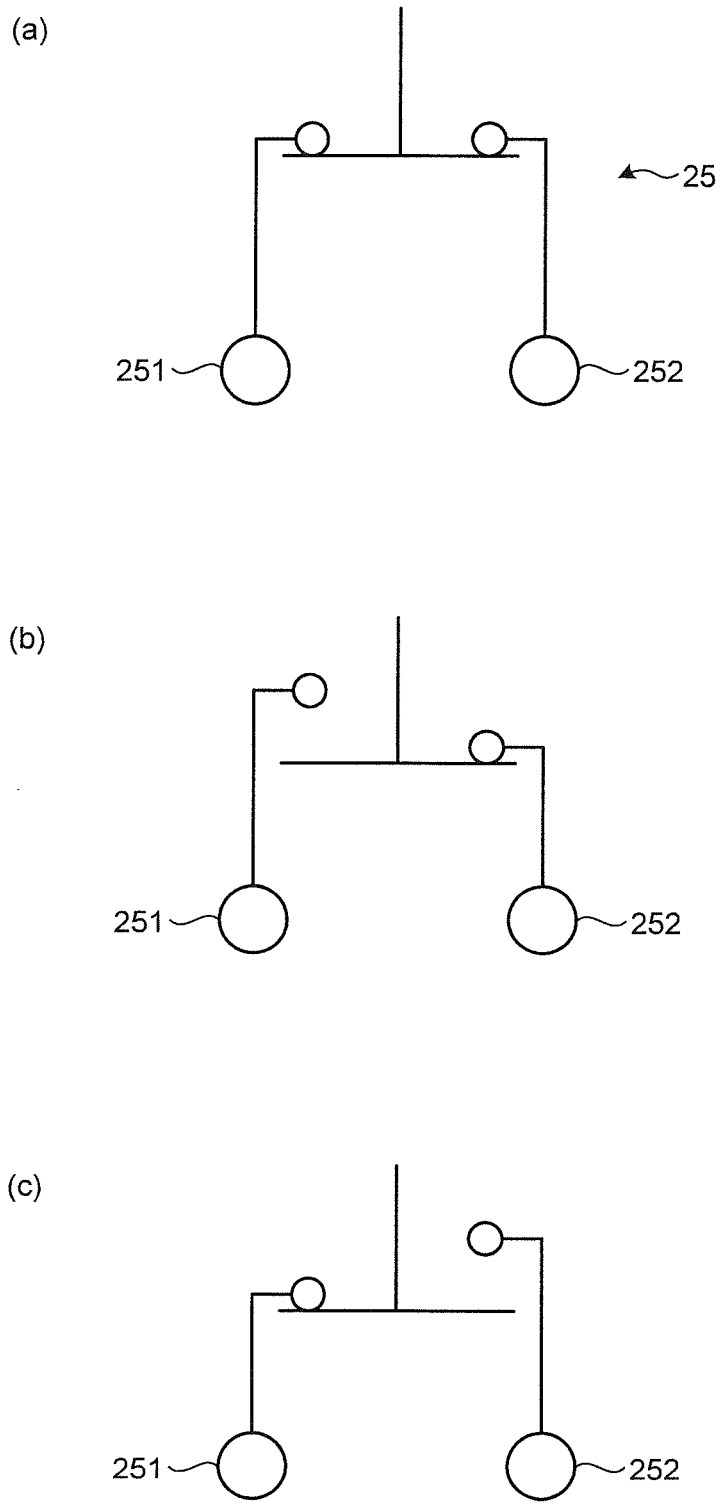
FIG. 10 is a diagram schematically illustrating a configuration of a sold-out detection switch.

According to the product dispensing system 20, since the first sold-out detection unit 25*a* and the second sold-out detection unit 25*b* are unified to constitute the sold-out detection switch 25, the output wirings can be commonized as illustrated in (a) to (c) of FIG. 10. Accordingly, it is possible to decrease the number of wirings and to reduce unbalance in assembly or the like and it is thus possible to achieve a decrease in manufacturing cost and facilitation in manufacturing work.

Figure 24:
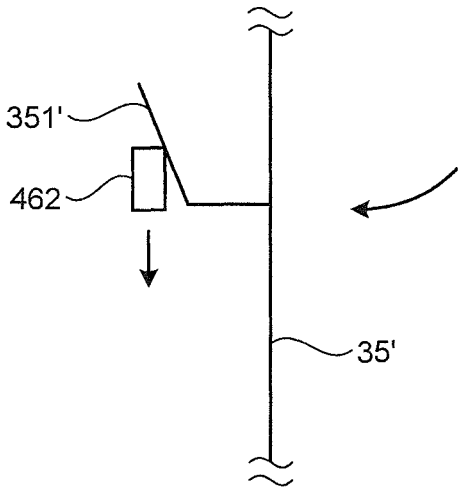
FIG. 24 is a diagram illustrating an operation of a contact piece of a pedal link.

According to the product dispensing system 20, the contact piece 351' of the pedal link 35' constituting the second product discharging device 20*b* extends forward, extends obliquely upward, that is, extends toward the first product discharging device 20*a*, and then extends to be gradually inclined so as to be separated from a reference position while approaching the first product discharging device 20*a*. Accordingly, when the second product discharging device 20*b* is attached to the first product discharging device 20*a* as illustrated in FIG. 22 and the second link lever 462 takes a posture in which the second link lever swings upward, the contact piece can come in contact with the second link lever 462 and guide the second link lever downward as illustrated in FIG. 24. As a result, it is possible to easily attach the second product discharging device 20*b*.

According to the product dispensing system 20, since the pedal links 35 and 35' are long plate-like members extending in the vertical direction and the top portions thereof are bent forward and then extend upward, curved portions are formed in the middle way thereof. Accordingly, even when a strong impact acts on the lower pedals 28 and 28' or the like due to contact of a product, the curved portions can be bent to exhibit a damper effect, thereby preventing the impact from acting on the drive unit 40 or the like.

According to the product dispensing system 20, since the regulation portion 81 of the wiring cover 80 regulates displacement of the lower end 241' of the bearing portion 24' going into the wiring cover 80 in the direction of approaching the first product discharging device 20*a*, the following operational advantages can be obtained. That is, the second product discharging device 20*b* does not include the sold-out detection switch 25 and the drive unit 40 unlike the first product discharging device 20*a*, and thus is less in weight than the first product discharging device 20*a*. Accordingly, the second product discharging device 20*b* can more easily move upward and downward relative to the first product discharging device 20*a* at the time of discharging a product. As a result, when the lower end 241' of the bearing portion 24' is displaced in the direction separated away from the base 21', the second product discharging device 20*b* may depart from the first product discharging device 20*a*. However, since the regulation portion 81 regulates the displacement of the lower end 241' in the direction of approaching the first product discharging device 20*a*, it is possible to prevent the second product discharging device 20*b* from departing from the first product discharging device 20*a* at the time of discharging a product.

According to the product dispensing system 20, since the motor 43 as a drive source is a DC motor, the motor is not easily affected by a local voltage or a frequency fluctuation and can be disposed at various locations.

According to the product dispensing system 20, since the first product discharging device 20*a* is provided with the sold-out detection switch 25 (the first sold-out detection unit 25*a* and the second sold-out detection unit 25*b*), it may be possible to use only the first product discharging device 20*a*. Accordingly, it is possible to flexibly work depending on the number of product storage passages 13 adjacent in the front-rear direction. In addition, since electrical components are disposed in only the first product discharging device 20*a*, harnesses can be integrated in the first product discharging device 20*a*.

In the first product discharging device 20*a*, the first sold-out detection unit 25*a* switches its state to detect presence or absence of the first product in the first product storage passage 13*a* when the lower pedal 28 transitions to the product-absent standby posture and the product-present standby posture, and the second sold-out detection unit 25*b* switches its state to detect presence or absence of the second product in the second product storage passage 13*b* when the lower pedal 28' transitions to the product-absent standby posture and the product-present standby posture. Accordingly, it is possible to satisfactorily recognize that no product is present in the product storage passages 13 and to match the number of sales opportunities of product with the number of products in the product storage passages 13. Therefore, according to the first product discharging device 20*a*, it is possible to increase the number of product sales opportunities.

When products are placed on the lower pedals 28 and 28', contents of a product flow out due to damage of a product pack or the like, and the weight of the product decreases, the lower pedal 28 or 28' transitions to the product-absent standby posture. Accordingly, since there is no possibility that a product not having a body as product will be sold, it is possible to prevent sale troubles.

According to the first product discharging device 20*a* and the second product discharging device 20*b*, the tip portions of the lever members 60 and 60' disposed in the bases 21 and 21' such that the tip portions move forward to and backward from the product storage passages 13 in the areas above the upper pedals 29 and 29' are biased by the lever spring 62 to move forward to the product storage passages 13 in the normal state, and move backward from the product storage passages 13 against the biasing force of the lever spring 62 when the tip portions come in contact with a product passing through the product storage passages. Accordingly, it is possible to stabilize the posture of a product passing through the product storage passages 13.

According to the first product discharging device 20*a* and the second product discharging device 20*b*, since the protrusions 213 protruding to the product storage passages 13 are formed in the vicinity of the openings formed in the areas above the upper pedals 29 and 29', it is possible to prevent a product passing through the product storage passage 13 from coming in contact with the edges of the openings and thus to prevent damage of the product.

In the first product discharging device 20*a* and the second product discharging device 20*b*, since the rotation stoppers 36 and 36' include the blindfold portions 36*c* and 36*c'* covering the sides of the pedal stopper pins 34*b* and 34*b'* opposite to the product storage passages 13, a blindfold plate as in the related art is not necessary and it is possible to retain the antitheft capability while decreasing the number of components. As a result, according to the first product discharging device 20*a* and the second product discharging device 20*b*, it is possible to achieve a decrease in manufacturing cost and to improve the antitheft capability.

While the exemplary embodiment of the present disclosure has been described above, the present disclosure is not limited to the exemplary embodiment and can be modified in various forms.

In the above-mentioned embodiment, the first product discharging device 20*a* corresponds to the first product storage passage 13*a* and the second product discharging device 20*b* corresponds to the second product storage passage 13*b*, but the present disclosure is not limited to this configuration. One product discharging device may correspond to the other product storage passage and the other product discharging device may correspond to one product storage passage.

According to the present disclosure, since the rotation stopper includes a blindfold portion covering the side of the pedal stopper pin opposite to the product storage passage, the blindfold plates as in the related art are not necessary and it is possible to decrease the number of components and to retain antitheft capability. Accordingly, it is possible to achieve a decrease in manufacturing cost and improvement in antitheft capability.

Additional advantages and modifications will readily occur to those skilled in the art. Therefore, the disclosure in its broader aspects is not limited to the specific details and representative embodiments shown and described herein. Accordingly, various modifications may be made without departing from the spirit or scope of the general inventive concept as defined by the appended claims and their equivalents.

What is claimed is:

1. A product discharging device comprising:

a lower pedal swingably disposed to move forward to and backward from a product storage passage storing input products in a vertical direction;

an upper pedal swingably disposed to move forward to and backward from the product storage passage in an area above the lower pedal;

a pedal stopper pin coupled to a pedal link linking the lower pedal and the upper pedal, the pedal stopper pin being movable with movement of the pedal link in a vertical direction;

a rotation stopper having a tip linked to the lower pedal and swingably disposed to move forward to and backward from the product storage passage along with the lower pedal; and a drive unit configured to move the pedal link downward to transition from an activated state to a standby state and to move the pedal link upward to transition from the standby state to the activated state, wherein when the pedal link moves downward, the upper pedal moves backward from the product storage passage, and the lower pedal moves forward to the product storage passage and is held at the product storage passage to regulate downward movement of the product by regulating backward movement of the rotation stopper due to the pedal stopper pin, when the pedal link moves upward, the upper pedal moves forward to the product storage passage to come in contact with a second lowest product, and the lower pedal moves backward from the product storage passage to discharge a lowest product downward by releasing the regulation of the backward movement of the rotation stopper due to the pedal stopper pin, the rotation stopper includes a blindfold portion that covers the pedal stopper pin on a side opposite to the product storage passage, and the blindfold portion is a panel portion fixed to the rotation stopper and structured to move toward the pedal stopper pin when the pedal link is moved downward, and to move away from the pedal stopper pin when the pedal link is moved upward.

2. The product discharging device according to claim 1, wherein a protrusion protruding to the product storage passage is formed in the vicinity of an opening formed in an area above the upper pedal.

3. The product discharging device according to claim 1, wherein in the standby state, the lower pedal has a first standby posture to regulate downward movement of the lowest product when the lowest product is placed on a top surface thereof and a second standby posture in which a tip portion of the lower pedal is located higher than in the first standby posture when no product is placed on the top surface, and the product discharging device further comprises a sold-out detection switch that is switched to an ON state or an OFF state when the lower pedal takes the first standby posture and is switched to the OFF state or the ON state when the lower pedal takes the second standby posture so as to detect presence or absence of a product of the product storage passage.

4. The product discharging device according to claim 2, wherein in the standby state, the lower pedal has a first standby posture to regulate downward movement of the lowest product when the lowest product is placed on a top surface thereof and a second standby posture in which a tip portion of the lower pedal is located higher than in the first standby posture when no product is placed on the top surface, and the product discharging device further comprises a sold-out detection switch that is switched to an ON state or an OFF state when the lower pedal takes the first standby posture and is switched to the OFF state or the ON state when the lower pedal takes the second standby posture so as to detect presence or absence of a product of the product storage passage.

* * * * *